US010766644B2

(12) United States Patent
May et al.

(10) Patent No.: US 10,766,644 B2
(45) Date of Patent: Sep. 8, 2020

(54) APPARATUS AND METHOD FOR FORMING A CARTON

(71) Applicant: Graphic Packaging International, Inc., Atlanta, GA (US)

(72) Inventors: Kevin T. May, Kennesaw, GA (US); Kelly Ziegler, Crosby, MN (US)

(73) Assignee: Graphic Packaging International, LLC, Atlanta, GA (US)

( * ) Notice: Subject to any disclaimer, the term of this patent is extended or adjusted under 35 U.S.C. 154(b) by 273 days.

(21) Appl. No.: 15/680,551

(22) Filed: Aug. 18, 2017

(65) Prior Publication Data

US 2017/0349308 A1 Dec. 7, 2017

Related U.S. Application Data

(62) Division of application No. 13/589,485, filed on Aug. 20, 2012, now Pat. No. 9,776,750.

(60) Provisional application No. 61/575,354, filed on Aug. 19, 2011.

(51) Int. Cl.

| | |
|---|---|
| ***B65B 21/24*** | (2006.01) |
| ***B65B 17/02*** | (2006.01) |
| ***B65B 49/14*** | (2006.01) |
| *B65B 43/12* | (2006.01) |
| *B65B 35/44* | (2006.01) |

(Continued)

(52) U.S. Cl.

CPC ..... *B65B 17/025* (2013.01); *B65B 21/24* (2013.01); *B65B 49/14* (2013.01); *B65B 11/004* (2013.01); *B65B 11/08* (2013.01); *B65B 35/44* (2013.01); *B65B 43/12* (2013.01); *B65B 43/126* (2013.01)

(58) Field of Classification Search

CPC ..... B65B 17/025; B65B 21/24; B65B 49/14
USPC ..... 53/457
See application file for complete search history.

(56) References Cited

U.S. PATENT DOCUMENTS

| | | | |
|---|---|---|---|
| 1,527,399 | A | 2/1925 | Davidson |
| 2,111,621 | A | 3/1938 | Gerking |
| 2,289,859 | A | 7/1942 | Arthur |

(Continued)

FOREIGN PATENT DOCUMENTS

| | | | |
|---|---|---|---|
| EP | 0 240 126 | A2 | 10/1987 |
| EP | 0 242 992 | A2 | 10/1987 |

(Continued)

OTHER PUBLICATIONS

International Search Report and Written Opinion for PCT/US2012/051551 dated Jan. 2, 2013.

(Continued)

*Primary Examiner* — Michelle Lopez
*Assistant Examiner* — Chinyere J Rushing-Tucker
(74) *Attorney, Agent, or Firm* — Womble Bond Dickinson (US) LLP

(57) ABSTRACT

An apparatus for faulting a carton containing a group of articles and a method of forming a carton. The apparatus comprises an article positioning system for positioning articles into a plurality of groups of articles and moving the groups of articles along a processing path, a blank handling apparatus for conveying a plurality of carton blanks towards the plurality of groups of articles, and a folding mechanism that is downstream of the blank handling apparatus for folding a portion of the ends of each respective carton blank downwardly around the respective group of articles.

12 Claims, 28 Drawing Sheets

(51) Int. Cl.
*B65B 11/00* (2006.01)
*B65B 11/08* (2006.01)

(56) References Cited

U.S. PATENT DOCUMENTS 2,522,950 A 9/1950 Keith
2,575,654 A 11/1951 Casler
2,726,583 A 12/1955 Barnes et al.
2,798,603 A 7/1957 Grinspoon
2,950,041 A 8/1960 Stone
3,022,615 A 2/1962 Schroeder et al.
3,065,679 A 11/1962 Clement
3,073,440 A 1/1963 Jones
3,364,826 A 1/1968 Austin, Jr. et al.
3,474,590 A 10/1969 Ganz
3,528,697 A 9/1970 Wood
3,599,776 A 8/1971 Babunovic
3,648,573 A 3/1972 LeFebvre et al.
3,800,677 A 4/1974 Jones et al.
3,878,665 A 4/1975 Couten
3,897,873 A 8/1975 Graser
3,940,907 A 3/1976 Ganz
3,942,631 A 3/1976 Sutherland et al.
3,952,634 A 4/1976 Rollins et al.
4,024,693 A 5/1977 Leasure et al.
4,028,999 A 6/1977 Lee
4,029,204 A 6/1977 Manizza
4,079,663 A 3/1978 Heller
4,096,985 A 6/1978 Wood
4,100,715 A 7/1978 Ganz
4,121,506 A 10/1978 Van Grouw
4,123,966 A 11/1978 Buschor
4,164,171 A 8/1979 Meyers et al.
4,190,149 A 2/1980 Oliff et al.
4,287,699 A 9/1981 Hart
4,304,329 A 12/1981 Graser
4,372,599 A 2/1983 Kiedaisch et al.
4,378,878 A 4/1983 Graser
4,378,879 A 4/1983 Killy
4,382,505 A 5/1983 Sutherland et al.
4,386,699 A 6/1983 Sutherland
4,403,689 A 9/1983 Wood
4,465,180 A 8/1984 Klygis
4,548,021 A 10/1985 Bader et al.
4,554,778 A 11/1985 Calvert
4,582,552 A 4/1986 Fitzgibbon et al.
4,619,637 A 10/1986 Jones
4,646,917 A 3/1987 Schuster
4,681,217 A 7/1987 Hernandez
4,736,977 A 4/1988 Killy
4,784,266 A 11/1988 Chaussadas
4,941,624 A 7/1990 Schuster
5,131,208 A 7/1992 Paul et al.
5,139,147 A 8/1992 Sutherland
5,163,548 A 11/1992 Domansky
5,177,930 A 1/1993 Harston et al.
5,188,225 A 2/1993 Jorba et al.
5,201,412 A 4/1993 Schuster et al.
5,267,644 A 12/1993 Tsao et al.
5,273,156 A 12/1993 Harris
5,297,673 A 3/1994 Sutherland
5,310,050 A 5/1994 Sutherland
5,310,051 A 5/1994 Sutherland
5,311,994 A 5/1994 Oliff
5,314,224 A 5/1994 Bates
5,323,895 A 6/1994 Sutherland et al.
5,328,024 A 7/1994 Sutherland
5,344,006 A 9/1994 Mazzeo
5,351,815 A 10/1994 Fogle et al.
5,351,816 A 10/1994 Sutherland et al.
5,351,817 A 10/1994 Sutherland
5,355,999 A 10/1994 Sutherland
5,359,830 A * 11/1994 Olson ..... B65B 17/025 53/398
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,474,172 A 12/1995 Zavatone et al.
5,501,335 A 3/1996 Harris
5,503,267 A 4/1996 Sutherland
5,520,283 A 5/1996 Sutherland
5,524,756 A 6/1996 Sutherland
5,551,566 A 9/1996 Sutherland
5,582,289 A 12/1996 Wright
5,590,776 A 1/1997 Galbierz et al.
5,593,027 A 1/1997 Sutherland
5,626,002 A 5/1997 Ford
5,638,659 A * 6/1997 Moncrief ..... B65B 35/44 53/251
5,639,017 A 6/1997 Fogle
5,653,084 A 8/1997 Mueller
5,724,785 A * 3/1998 Malanowski ..... B65B 21/24 53/252
5,735,394 A 4/1998 Harrelson
5,746,310 A 5/1998 Slomski
5,791,463 A 8/1998 Negelen
5,794,778 A 8/1998 Harris
5,809,746 A * 9/1998 DePuy ..... B65B 43/265 53/458
5,816,391 A 10/1998 Harris
5,871,090 A 2/1999 Doucette et al.
5,873,515 A 2/1999 Dunn et al.
5,915,546 A 6/1999 Harrelson
5,921,392 A 7/1999 Davis
5,960,945 A 10/1999 Sutherland
5,979,147 A 11/1999 Reuteler
5,979,747 A 11/1999 Gnadt et al.
5,992,733 A 11/1999 Gomes
6,042,527 A 3/2000 Anderson et al.
6,059,099 A 5/2000 Galbierz
6,065,590 A 5/2000 Spivey
6,282,864 B1 * 9/2001 Janen ..... B65B 21/24 53/209
6,311,457 B1 * 11/2001 May ..... B65B 43/185 53/389.1
6,315,111 B1 11/2001 Sutherland
6,484,903 B2 11/2002 Spivey et al.
6,490,843 B1 * 12/2002 May ..... B65B 43/185 53/389.1
6,550,608 B1 * 4/2003 Brown ..... B65B 21/242 198/837
6,779,655 B2 8/2004 Olsen et al.
6,896,130 B2 5/2005 Theelen
6,926,193 B2 8/2005 Smalley
7,011,209 B2 3/2006 Sutherland et al.
7,823,721 B2 11/2010 Sutherland et al.
8,353,398 B2 1/2013 DePaula et al.
2002/0195371 A1 12/2002 Brown
2003/0080004 A1 5/2003 Olsen et al.
2003/0111362 A1 6/2003 Sutherland et al.
2003/0213705 A1 11/2003 Woog
2005/0127151 A1 6/2005 Johnson
2006/0154791 A1 7/2006 Reuteler
2006/0207220 A1 * 9/2006 Ford ..... B65B 21/242 53/398
2007/0029371 A1 2/2007 Theelen
2007/0164091 A1 7/2007 Fogle et al.
2007/0181658 A1 8/2007 Sutherland
2007/0240381 A1 10/2007 Alfonso
2009/0101526 A1 4/2009 Sutherland
2009/0127147 A1 5/2009 Sutherland
2009/0250357 A1 10/2009 Spivey, Sr.
2010/0078337 A1 4/2010 Sutherland et al.
2010/0264043 A1 10/2010 De Paula

(56) References Cited

U.S. PATENT DOCUMENTS

| | | | | |
|---|---|---|---|---|
| 2011/0000799 | A1 | 1/2011 | Gonzalez et al. | |
| 2013/0111855 | A1* | 5/2013 | Hendricks | B65B 43/126 53/473 |

FOREIGN PATENT DOCUMENTS

| | | | |
|---|---|---|---|
| EP | 0 425 135 | A2 | 5/1991 |
| EP | 0 428 354 | A1 | 5/1991 |
| EP | 2 085 314 | A2 | 8/2009 |
| GB | 1 182 022 | A | 2/1970 |
| GB | 2238285 | | 5/1991 |
| GB | 2321229 | | 7/1998 |
| JP | 38-23891 | | 11/1938 |
| JP | 42-25271 | | 12/1942 |
| JP | 03-148459 | | 6/1991 |
| JP | 03-176374 | | 7/1991 |
| JP | 6-211212 | | 8/1994 |
| JP | 08-509944 | | 10/1996 |
| JP | 11-511104 | | 9/1999 |
| JP | 2003-146359 | | 5/2003 |
| JP | 2003-300554 | A | 10/2003 |
| JP | 2007-008475 | | 1/2007 |
| JP | 2011-502905 | | 1/2011 |
| WO | WO 94/06684 | A1 | 3/1994 |
| WO | WO 94/22738 | | 10/1994 |
| WO | WO 95/01289 | | 1/1995 |
| WO | WO 95/23091 | | 8/1995 |
| WO | WO 95/23745 | | 9/1995 |
| WO | WO 2009/064951 | A2 | 5/2009 |
| WO | WO 2011/075626 | A2 | 6/2011 |

OTHER PUBLICATIONS

Office Action for JP 2014-527216 dated Mar. 12, 2015.
Supplementary European Search Report for EP 12 82 5737 dated Dec. 19, 2014.
Notification of Reason for Refusal for JP 2014-527216 dated Jan. 5, 2016, with English translation.
Office Action for U.S. Appl. No. 13/589,485 dated Jun. 9, 2015.
Response to Restriction Requirement for U.S. Appl. No. 13/589,485 dated Jul. 27, 2015.
Office Action for U.S. Appl. No. 13/589,485 dated Aug. 27, 2015.
Supplemental Response to Office Action for U.S. Appl. No. 13/589,485 dated Dec. 2, 2015.
Amendment A and Response to Office Action for U.S. Appl. No. 13/589,485 dated Nov. 13, 2015.
Office Action for U.S. Appl. No. 13/589,485 dated Feb. 26, 2016.
Request for Continued Examination (RCE) Transmittal for U.S. Appl. No. 13/589,485 dated May 26, 2016.
Amendment B and Response to Final Office Action for U.S. Appl. No. 13/589,485 dated May 26, 2016.
Office Action for U.S. Appl. No. 13/589,485 dated Jun. 15, 2016.
Amendment C and Response to Office Action for U.S. Appl. No. 13/589,485 dated Aug. 25, 2016.
Office Action for U.S. Appl. No. 13/589,485 dated Sep. 29, 2016.
Request for Continued Examination (RCE) Transmittal for U.S. Appl. No. 13/589,485 dated Dec. 28, 2016.
Amendment D and Response to Final Office Action for U.S. Appl. No. 13/589,485 dated Dec. 28, 2016.
Office Action for U.S. Appl. No. 13/589,485 dated Feb. 24, 2017.
Amendment E and Response to Non-Final Office Action for U.S. Appl. No. 13/589,485 dated May 1, 2017.
Notice of Allowance and Fee(s) Due for U.S. Appl. No. 13/589,485 dated Jun. 2, 2017.
Issue Fee Transmittal Form for U.S. Appl. No. 13/589,485 dated Aug. 21, 2017.

* cited by examiner

APPARATUS AND METHOD FOR FORMING A CARTON

CROSS-REFERENCE TO RELATED APPLICATIONS

This application is a divisional application of U.S. patent application Ser. No. 13/589,485, filed Aug. 20, 2012, which claims the benefit of U.S. Provisional Application No. 61/575,354, which was filed on Aug. 19, 2011.

INCORPORATION BY REFERENCE

U.S. patent application Ser. No. 13/589,485, which was filed Aug. 20, 2012, and U.S. Provisional Application No. 61/575,354, which was filed on Aug. 11, 2011, are hereby incorporated by reference for all purposes as if presented herein in their entirety.

BACKGROUND OF THE DISCLOSURE

The present disclosure generally relates to article packaging apparatus, machines, and methods. More specifically, the present disclosure relates to apparatus and methods for forming a carton containing a group of articles such as beverage containers.

SUMMARY OF THE DISCLOSURE

In general, one aspect of the disclosure is directed to an apparatus for forming a carton containing a group of articles. The apparatus comprises an article positioning system for positioning articles into a plurality of groups of articles and moving the groups of articles along a processing path. A blank handling apparatus is for conveying a plurality of carton blanks towards the plurality of groups of articles. The blank handling apparatus comprises a presser assembly for pressing a respective carton blank of the plurality of carton blanks onto the tops of articles in a respective group of articles of the plurality of groups of articles as the respective carton blank engages the tops of the articles. A folding mechanism is downstream of the blank handling apparatus for folding a portion of the ends of each respective carton blank downwardly around the respective group of articles, the folding mechanism comprising at least one leading lug for folding a leading end portion of the carton blank against the respective group of articles and at least one trailing lug for folding a trailing end portion of the carton blank against the respective group of articles.

In another aspect, the disclosure is generally directed to a method of forming a carton containing a group of articles. The method comprises positioning a plurality of articles into a plurality of groups of articles and moving the groups of articles along a processing path. The method comprises moving a plurality of carton blanks towards the plurality of group of articles and pressing a respective carton blank of the plurality of carton blanks onto the tops of articles in a respective group of articles of the plurality of groups of articles and engaging the respective carton blank with the tops of the articles. The method comprises folding a respective carton blank around the respective group of articles. The folding comprises folding a leading end portion of the carton blank downwardly against the respective group of articles and folding a trailing end portion of the carton blank downwardly against the respective group of articles.

In other aspects, the disclosure is generally directed to various other features of the apparatus for forming the carton as shown and/or described herein.

In other aspects, the disclosure is generally directed to various other features of the method of forming the carton as shown and/or described herein.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to apparatus and methods for forming cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons formed by apparatus or methods according to the present disclosure can accommodate articles of any shape. For the purpose of illustration and not for the purpose of limiting the scope of the disclosure, the following detailed description describes beverage containers (e.g., plastic beverage bottles) as disposed within the carton embodiments. In this specification, the terms "lower," "bottom," "upper" and "top" indicate orientations determined in relation to fully erected and upright cartons.

Figure 1:
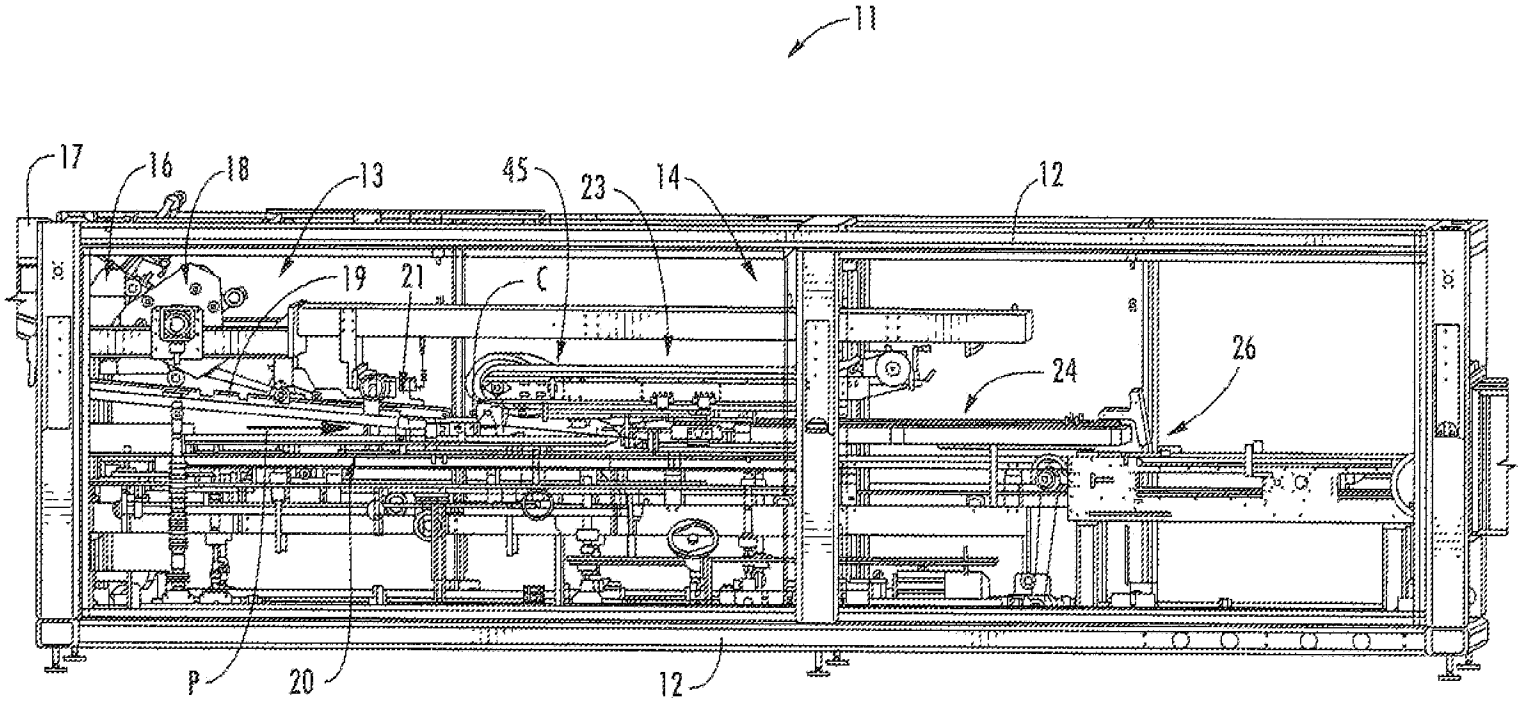
FIG. 1 is a side view of an apparatus for forming a carton according to one embodiment of the disclosure.
Figure 2:
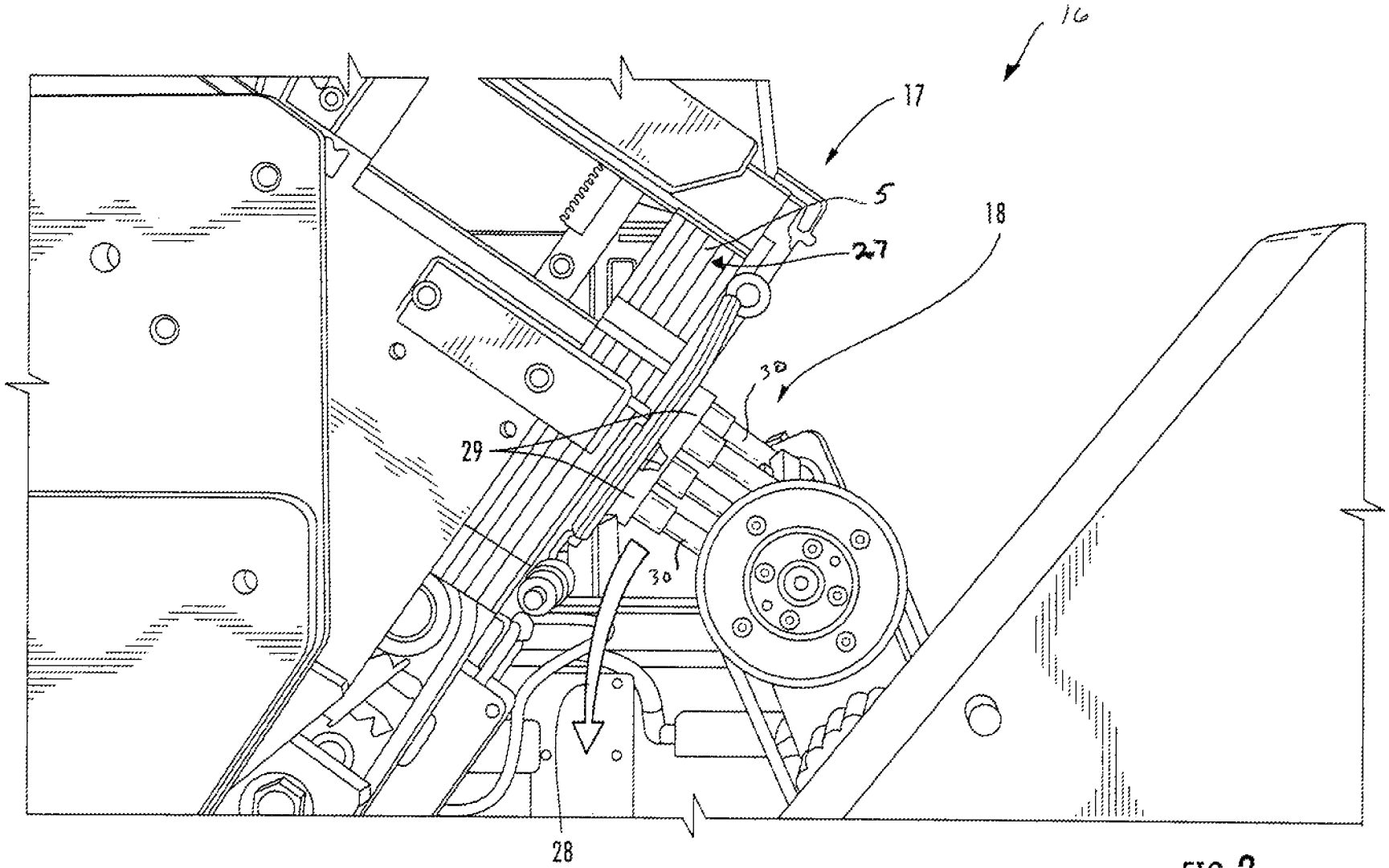
FIG. 2 is a side view of a portion of the apparatus of FIG. 1 showing a portion of a blank handling apparatus of one embodiment of the disclosure.
Figure 2A:
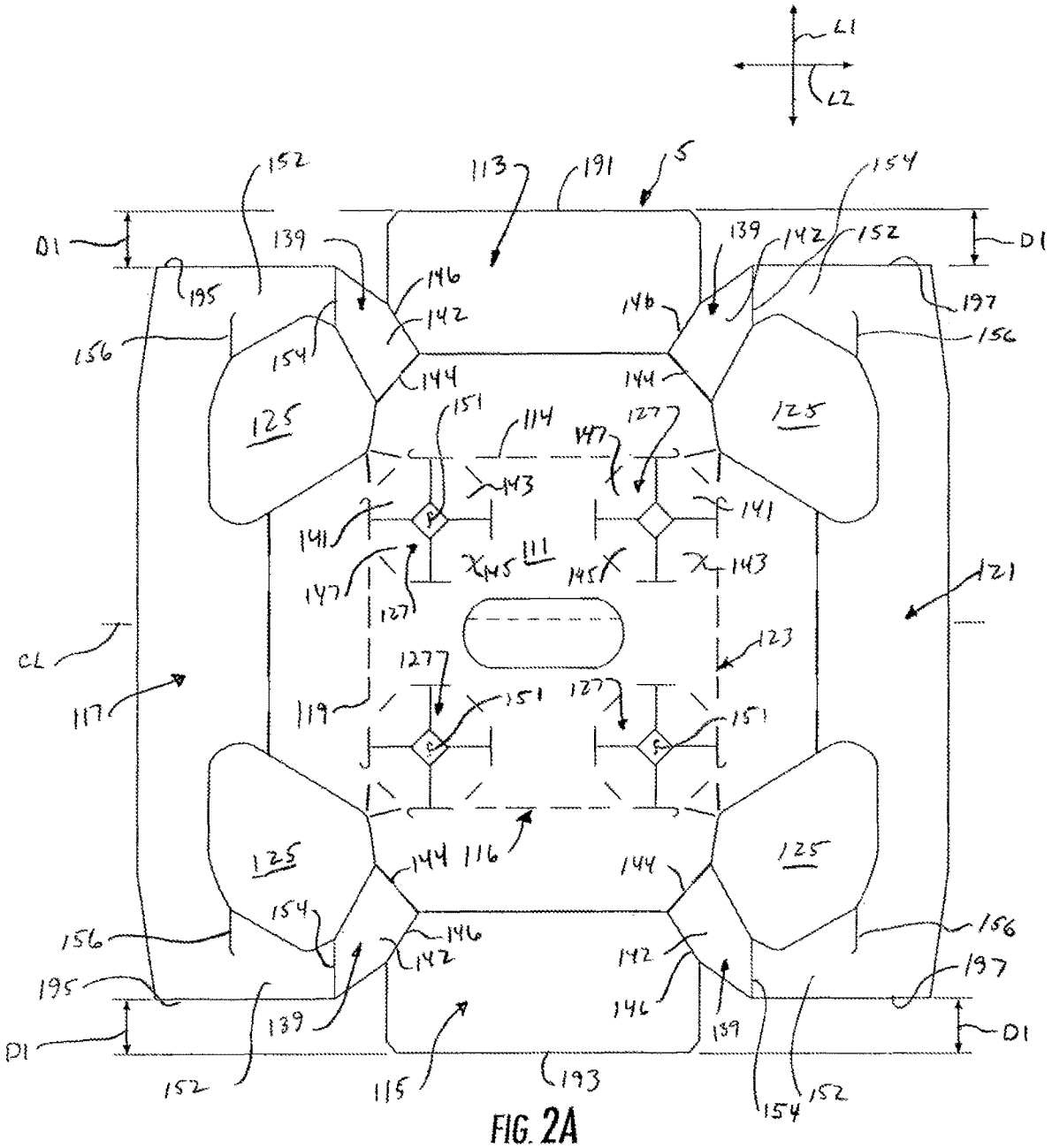
FIG. 2A is a detail plan view of one embodiment of a carton blank suitable for use in the apparatus of the present disclosure.

Referring now in more detail to the drawing figures, wherein like reference numerals indicate like parts throughout the several views, FIG. 1 illustrates an apparatus 11 for forming a carton 3 (FIG. 13E) from a carton blank 5 (FIG. 2A). The carton 3 and blank 5 shown in the illustrated embodiments are exemplary of the type of carton or blank that can be used in the apparatus 11 of the present disclosure, as the carton and/or blank could be otherwise shaped, arranged, configured, etc. without departing from the disclosure. The apparatus 11 can be referred to as a packaging machine and is used to form the carton 3 around a group of articles, such as beverage containers C (FIG. 13E). In the illustrated embodiments, the packaging machine 11 has features for attaching the blank 5 to a group of articles or containers C and folding portions of the blank around the articles to form the carton attached to the containers.

In one embodiment, the packaging machine 11 comprises a frame 12 configured to surround and support components of the machine. The machine 11 has an upstream end 13, a downstream end 14, with a processing path P extending from the upstream end to the downstream end. The apparatus 11 comprises a blank handling apparatus 16 that is disposed at the upstream end 13, and an article positioning system 20 for positioning articles C into a plurality of groups of articles and conveying the groups of articles at a precise rate along the processing path P from the upstream end 13 of the machine to the downstream end 14 of the machine. The blank handling apparatus 16 is configured to attach a respective blank 5 to a respective group of articles C formed by the article positioning system 20 with the attached blank and group of articles being further conveyed in the machine 11 for further forming the carton 3. In the illustrated embodiment, the article positioning system 20 groups the containers C into a group of four containers arranged in a 2×2 arrangement, but the article positioning system could be configured to arrange the containers in other than a 2×2 arrangement (e.g., 2×3, 2×4, 1×3, 1×4, 3×3, 3×4, etc.) without departing from the disclosure. The apparatus 11 includes a folding mechanism 45 downstream from the blank handling apparatus 16 that folds the blank 5 that is attached to the group of articles C to form the carton 3. Adhesive or glue can be applied to one or more flaps or panels of the blank 5 during the folding by the folding mechanism 45 or by other suitable mechanisms. After the carton 3 is formed in the apparatus 11, the carton is discharged at an exiting end 26 of the processing path P for further handling.

FIG. 2A illustrates an exemplary blank 5 that can be handled in the apparatus 11 of the present disclosure. The blank 5 is illustrated in further detail in U.S. patent application Ser. No. 12/971,297, filed Dec. 17, 2010, the entire disclosure of which is incorporated by reference herein for all purposes.

In one embodiment, the blank 5 has a longitudinal axis L1 and a lateral axis L2. The blank 3 comprises a top panel 111 foldably connected to a first end panel 113 at a lateral fold line 114, and a second end panel 115 foldably connected to the top panel at a lateral fold line 116. A first side panel 117 is foldably connected to the top panel 111 at a longitudinal fold line 119, and a second side panel 121 is foldably connected to the top panel 10 at a longitudinal fold line 123. In one embodiment, the blank 5 comprises four openings 125 that at least partially define the side panels 117, 121, end panels 113, 115 and top panel 111. In one embodiment, the apparatus 11 of the present disclosure is used to fold the end panels 113, 115, and side panels 117, 121 relative to the top panel 111 to at least partially form an interior of the carton 3 that contains the group of articles C.

In the illustrated embodiment, the top panel 111 comprises four receptacles 127 that receive a respective top portion of a respective container C of the group of containers that are contained in the carton 3. In one embodiment, the features of each receptacle 127 comprise four retention flaps 141, 143, 145, 147 that frame a respective opening 151 in the top panel 11 of the blank 5. Each of the retention flaps 141, 143, 145, 147 has free edges that engage a respective container C to restrain the container from removal from the blank 5 or carton 3. The retention flaps 141, 143, 145, 147 could be otherwise shaped, arranged, or configured without departing from the disclosure.

In one embodiment, the blank 5 comprises four gussets 139 that connect a respective one of the side panels 117, 121 to a respective one of the end panels 113, 115. Each of the gussets 139 comprises a first gusset panel 142 foldably connected to a respective end panel 113, 115 at an oblique fold line 144 and further defined by an oblique cut line 146. The gussets 139 each comprise a second gusset panel 152 foldably connected to the first gusset panel 142 at longitudinal fold line 154. The second gusset panel 152 is at least partially defined by a cut line 156 extending from an edge of a respective opening 125. The second gusset panel 152 is foldably connected to a respective side panel 117, 121 by the portion of the blank 5 that is adjacent the end of the cut line 156. The cut line 156 at least partially defines an adhesive portion at each end of a respective side panel 117, 121.

Figure 3:
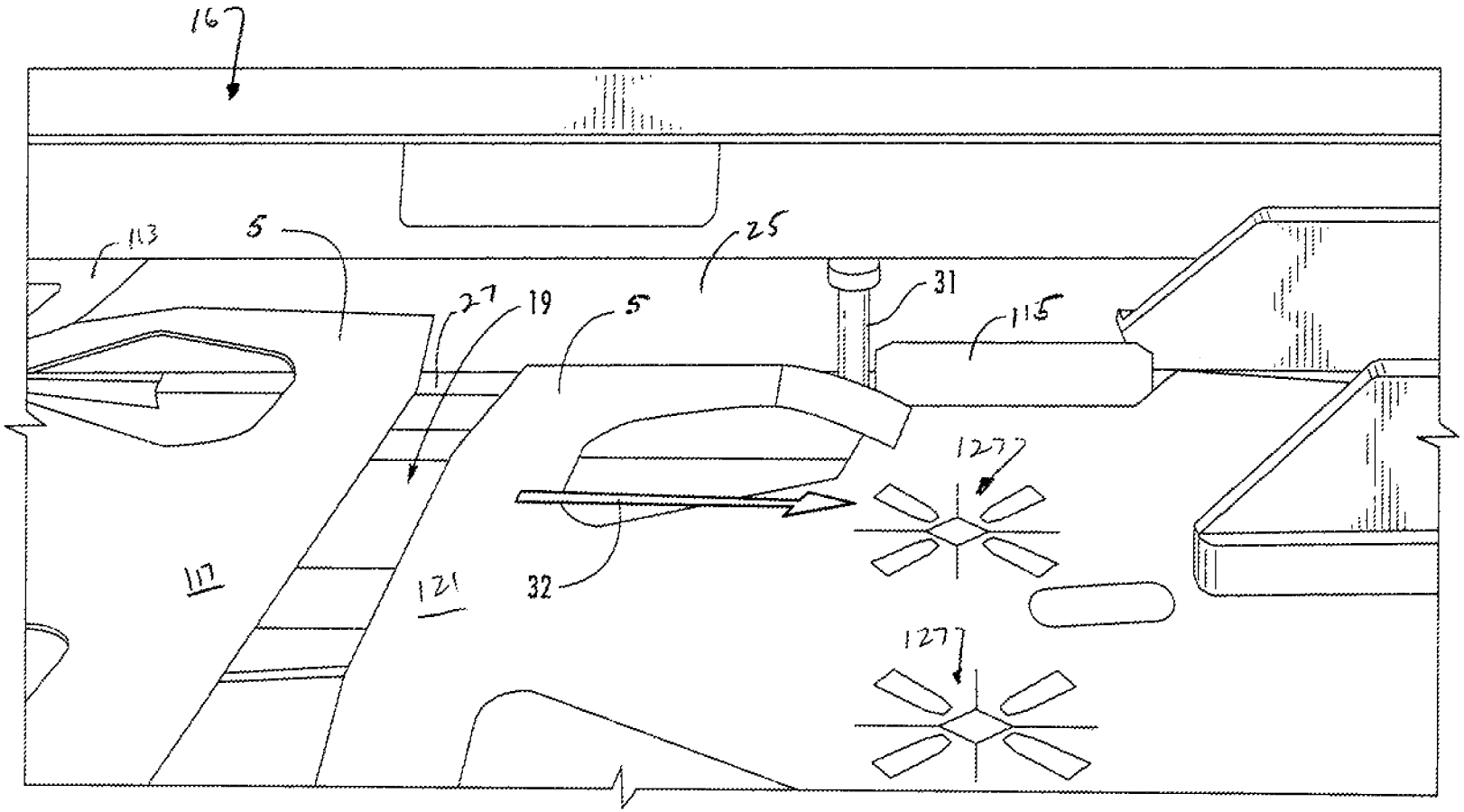
FIG. 3 is a schematic view of a portion of the apparatus of FIG. 1 showing a portion of the blank handling apparatus of one embodiment of the disclosure.
Figure 3A:
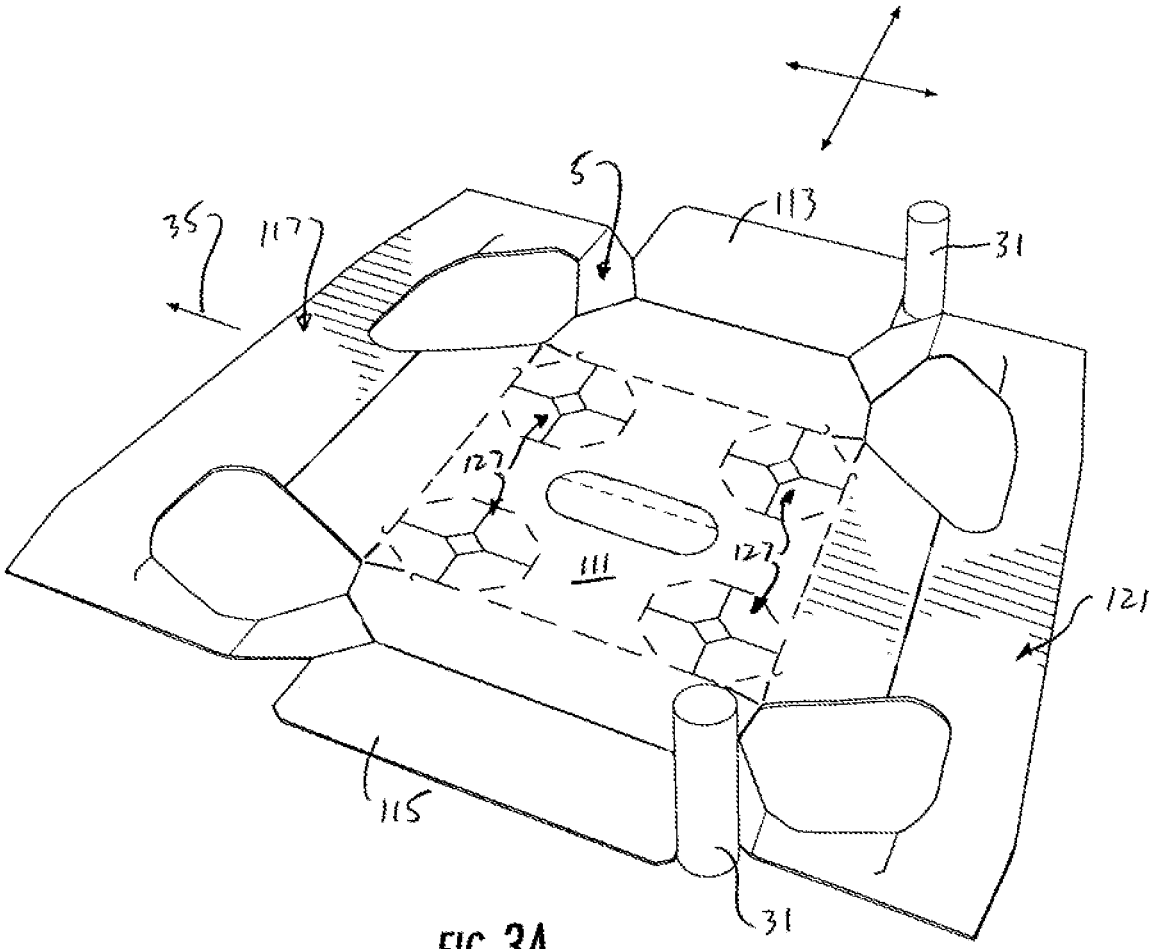
FIG. 3A is a detail perspective of a carton blank removed from the blank handling apparatus and showing the detail of a portion of the blank handling apparatus engaging the carton blank.
Figure 5:
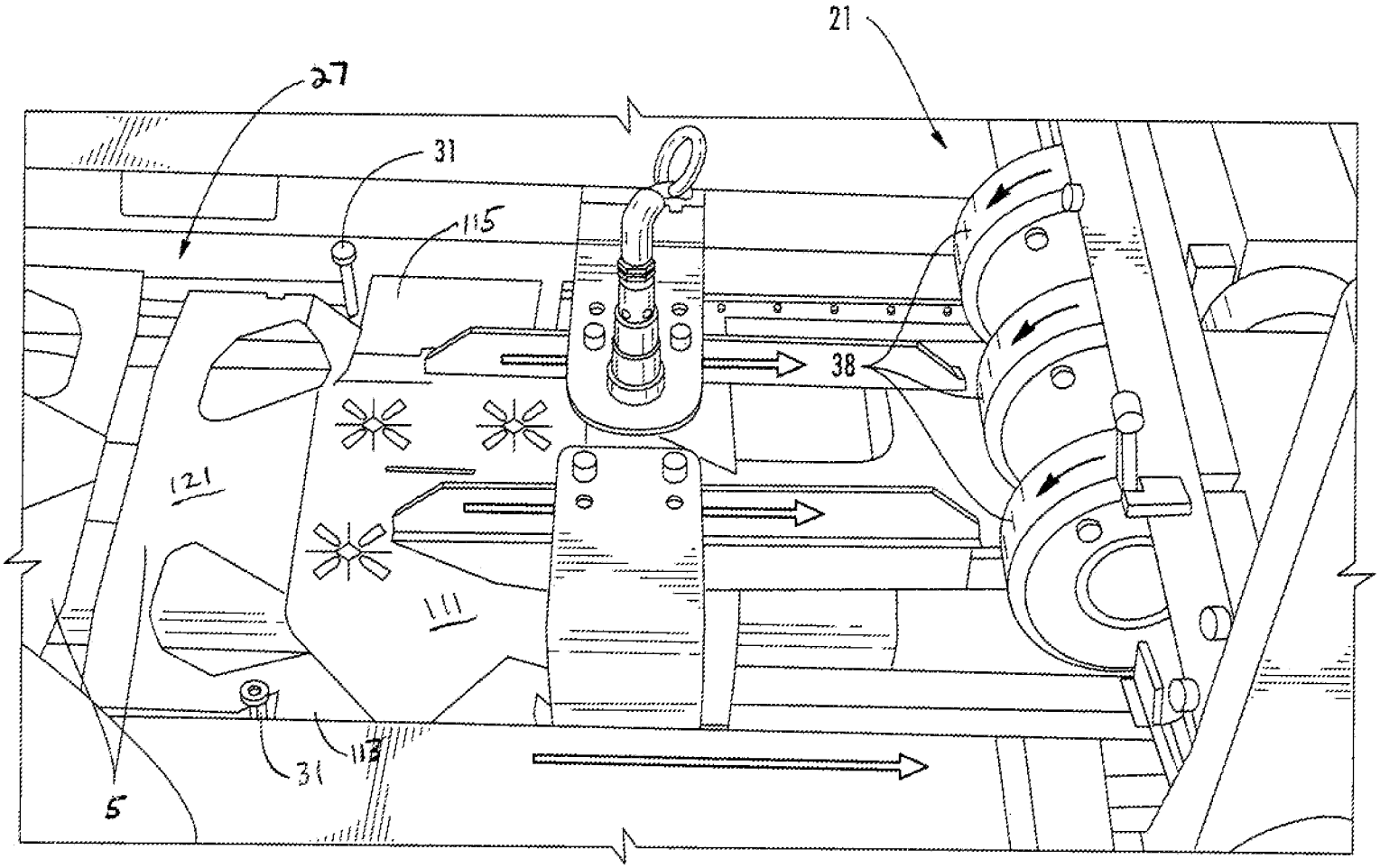
FIG. 5 is a schematic view of a portion of the blank handling apparatus.

In one embodiment, the blank 5 has outermost edges 191, 193 at the longitudinal ends of the blank corresponding to the free edges of the end panels 113, 115 that are spaced a farther distance from the laterally-extending centerline CL of the blank than the edges 195, 197 of the side panels 117, 121 at the longitudinal ends of the blank. In one embodiment, the outermost edges 191, 193 of the end panels 113, 115 are spaced apart from the edges 195, 197 of the side panels 117, 121 by a distance D1. In one exemplary embodiment, the distance D1 is at least approximately ⅝ inch (approximately 16 mm), but the distance D1 could be more or less without departing from the scope of the disclosure. As shown in FIGS. 3, 3A, and 5 and discussed in detail below, the blank handling apparatus 16 can have spacing pins 31 that engage the end panels 13, 15 to move the blanks in the downstream direction in the packaging machine 11. The spacing of the edges 191, 193 from the edges 195, 197 facilitates engagement of the blanks 5 and the pins 31 to convey the blank in the packaging machine 11.

In the illustrated embodiment, the blank handling apparatus 16 comprises a picker assembly 18 that is configured to pick carton blanks 5 from a carton magazine 17 (FIG. 2) that contains a stack 27 of carton blanks. The picker assembly 18 transfers the carton blanks 5 one-at-a-time from the stack 27 in the magazine 17 to a carton chute 19 (FIG. 3) that is located below and downstream from the picker assembly. As shown in FIG. 1, the carton chute 19 angles downwardly toward the path P of moving bottle groups C moving along the article conveyor assembly 20. The carton chute 19 transfers blanks 5 to a presser assembly 21 that is angled downwardly and has features for attaching the blanks 5 to a respective group of articles C.

As shown in FIG. 2, the picker assembly 18 includes the carton magazine 27 and vacuum cups 29 attached to articulating arms 30 that pick a single carton blank 5 from the stack 27 of blanks and rotate and move the blanks downwardly as indicated by arrow 28 to place the carton blanks on the carton cute 19. FIG. 3 shows the carton chute 19 with carton blanks 5 having been placed therein by the picker assembly 18. The carton chute 19 has side walls 25 and a pair of endless chains 27 to which are attached spacing pins 31 that are moved in the downstream direction indicated by arrow 32 by movement of the chains. Only one of the side walls 25 and endless chains 27 are visible in FIG. 3. The spacing pins 31 engage end panels 113, 115 of the carton blanks 5 and thereby move the blanks in a predetermined spaced relationship (determined by the spacing of the pins) along and down the carton chute 19. While the carton blanks 5 are shown in spaced apart single file configuration in FIG. 3, this may not necessarily be the case. The spacing pins 31 can be otherwise position as needed to accommodate blanks of varying size or alternative configuration, in which case adjacent blanks may well overlap. The arrangement of the spacing pins 31 and chains 27 provides versatility of the blank handling apparatus 16 so that larger and smaller articles and groups of articles of various configurations can be handle with the same apparatus or with slight modification and/or adjustment to the blank handling apparatus. FIG. 3A shows a detail view of a blank 5 removed from the blank handling apparatus 16 but showing the engagement of the spacing pins 31 of the carton chute 19 with the end panels 113, 115. The arrangement of the end panels 113, 115 of the blank 5 with the spacing of the edges 191, 193 from the edges 195, 197 by a distance D1 facilitates engagement of the blank with the pins 31. The spacing pins 31 engage the blank 5 to move the blank in the direction of travel indicated by arrow 35.

Figure 4:
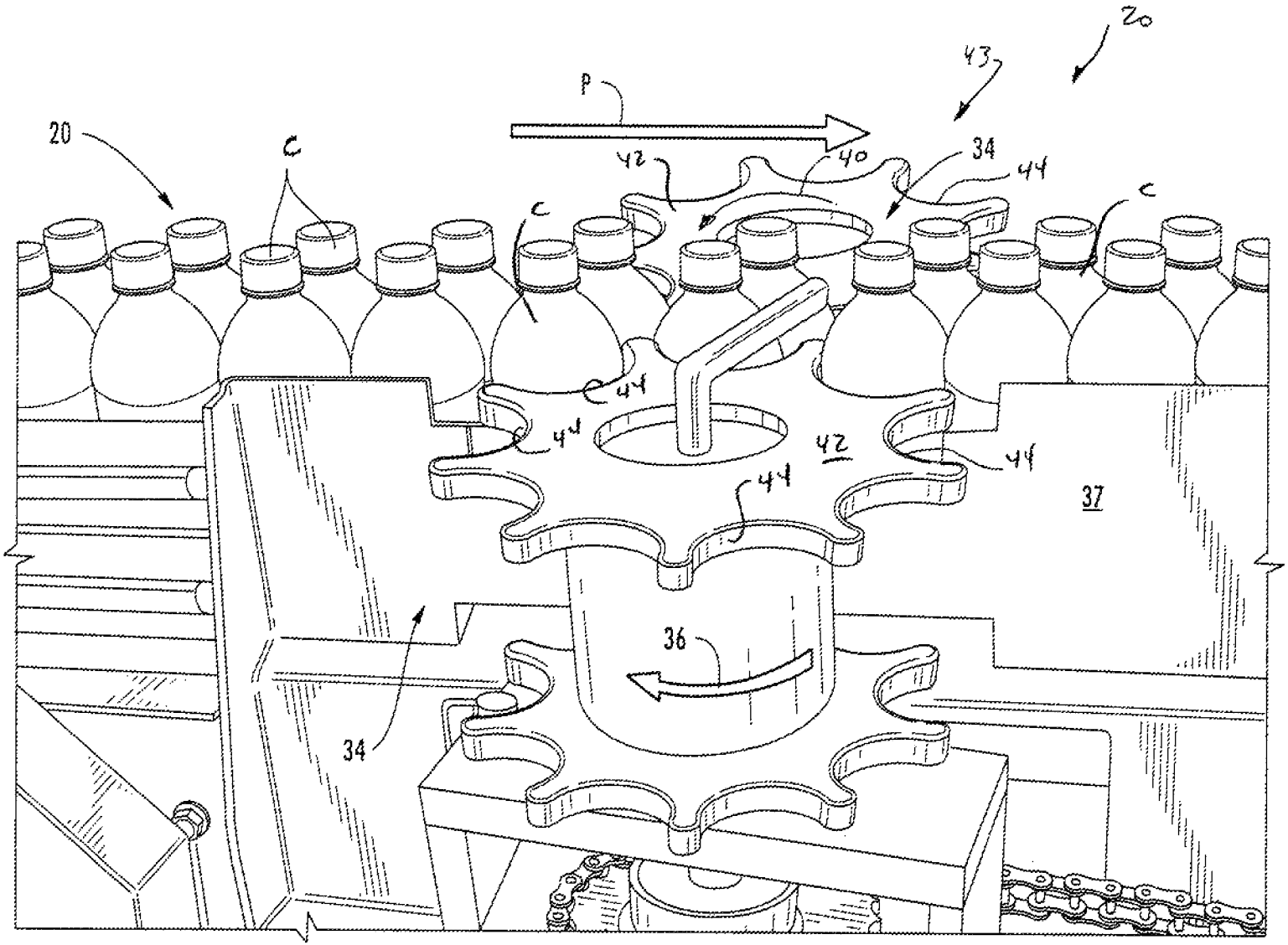
FIG. 4 is a schematic view of a portion of the apparatus of FIG. 1 showing a portion of an article positioning system of one embodiment of the disclosure.
Figure 4A:
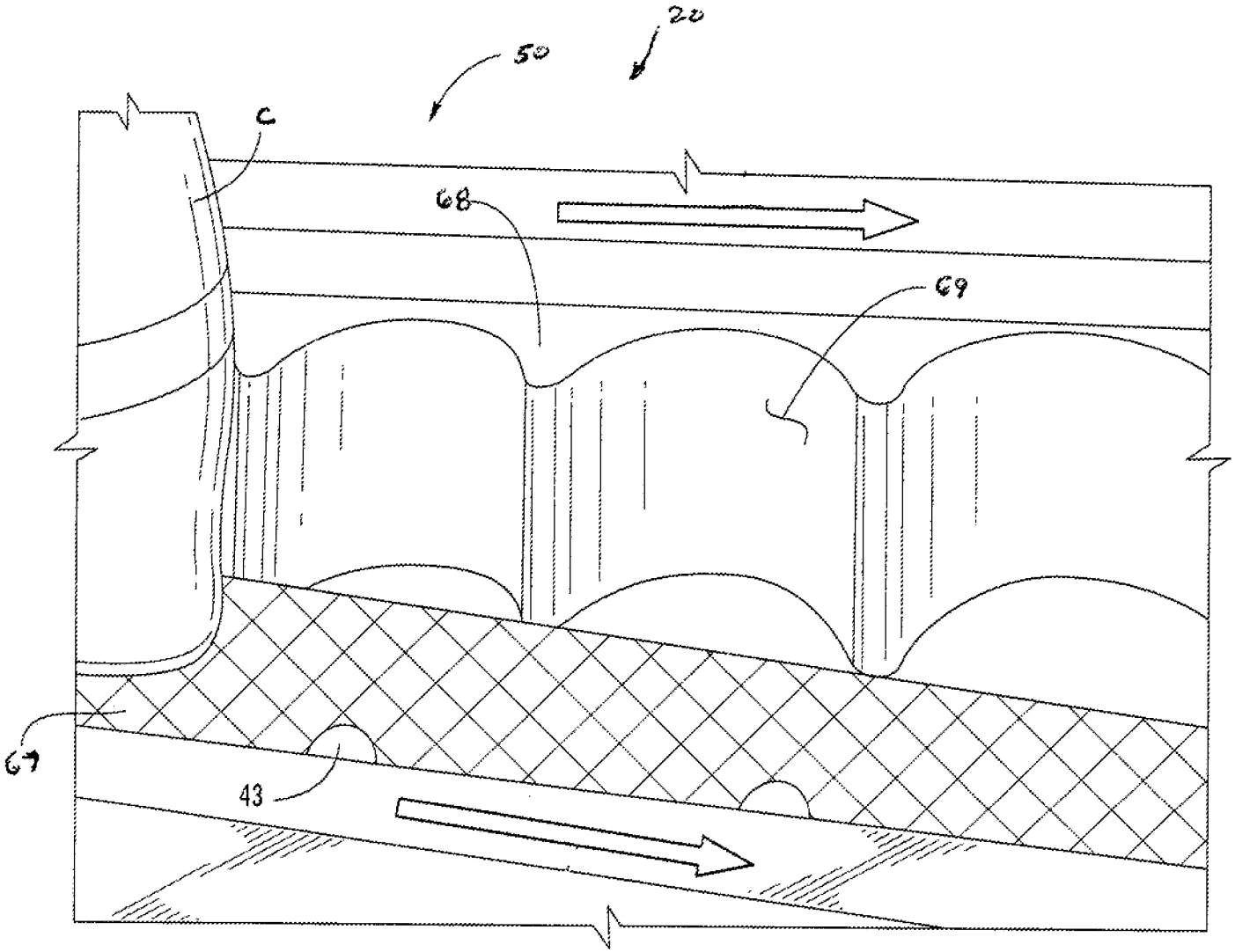
FIG. 4A is a schematic view of a portion of the article positioning system with some of the bottles removed to show details of the article positioning system.

FIG. 4 illustrates a first portion 43 of the article positioning system 20 for conveying beverage bottles along the processing path P in the downstream direction of the machine 11. The article conveyor assembly 20 has an endless conveyor belt (not visible) upon which the beverage bottles C are supported, and upstanding guide plates 37 that confine and organize the bottles on the belt. The conveyor belt moves the bottles C downstream until they encounter starwheel assemblies 34 on each side of the processing path P. As illustrated in FIG. 4, the starwheel assemblies 34 are rotated in opposite directions (the near wheel being rotated in direction 36 and the far wheel being rotated in direction 40) by suitable drive mechanisms (not shown). The top portion 42 of the starwheel assemblies 34 have article receiving surfaces 44 that are shaped to conform to the shape of the container C to capture the containers and meter the conveying rate of the containers. The containers C are conveyed from the first portion 43 of the article positioning system 20 downstream, where they are grouped as described in more detail below by a gripper assembly 50 (FIG. 4A). A dead plate (not shown) is disposed between the starwheels and the gripper assembly 50 so that the star wheel assemblies 34 push the bottles across the deadplate to the gripper assembly 50.

FIG. 4A illustrates the gripper assembly 50 of the article positioning system 20 and shows it as having an endless belt 67 upon which the bottles C rest and ride. The belt 67 is flanked by moving gripper belts 68 that move in synchronization with the endless belt below. The gripper belts 68 are formed with article-receiving recesses 69 sized to caress a beverage bottle C and position it precisely with respect to adjacent bottles of a group. The starwheel assemblies 34 meter the bottles C to the gripper assembly 50 such that groups of bottles separated by spaces are captured by the gripper assembly and moved along the processing path P. The starwheel assemblies 34 can be controlled to create groups of 2×2, 2×4; 2×6, or any other numbers of bottles as needed. The gripper assembly 50 is synchronized with the chains or belts 27 of the carton chute 19 above such that each group of bottles C moves in precise vertical alignment with and in precise synchronization with a corresponding carton blank 5 moving down the carton chute above. In one embodiment, the gripper belts 68 and bottom belt 67 are configured to accelerate movement of the containers C such that the speed of movement of the group of containers that are discharged from the gripper assembly 50 is greater than the speed of movement of the group of containers that are discharged from the first portion 43 of the article positioning system 20. Since the carton chute 19 is angled downward along the path of travel P as described, the carton blanks 5 progressively approach their aligned bottle groups below. The article positioning system 20 could be otherwise shaped, arranged, and/or configured without departing from the disclosure.

Figure 6:
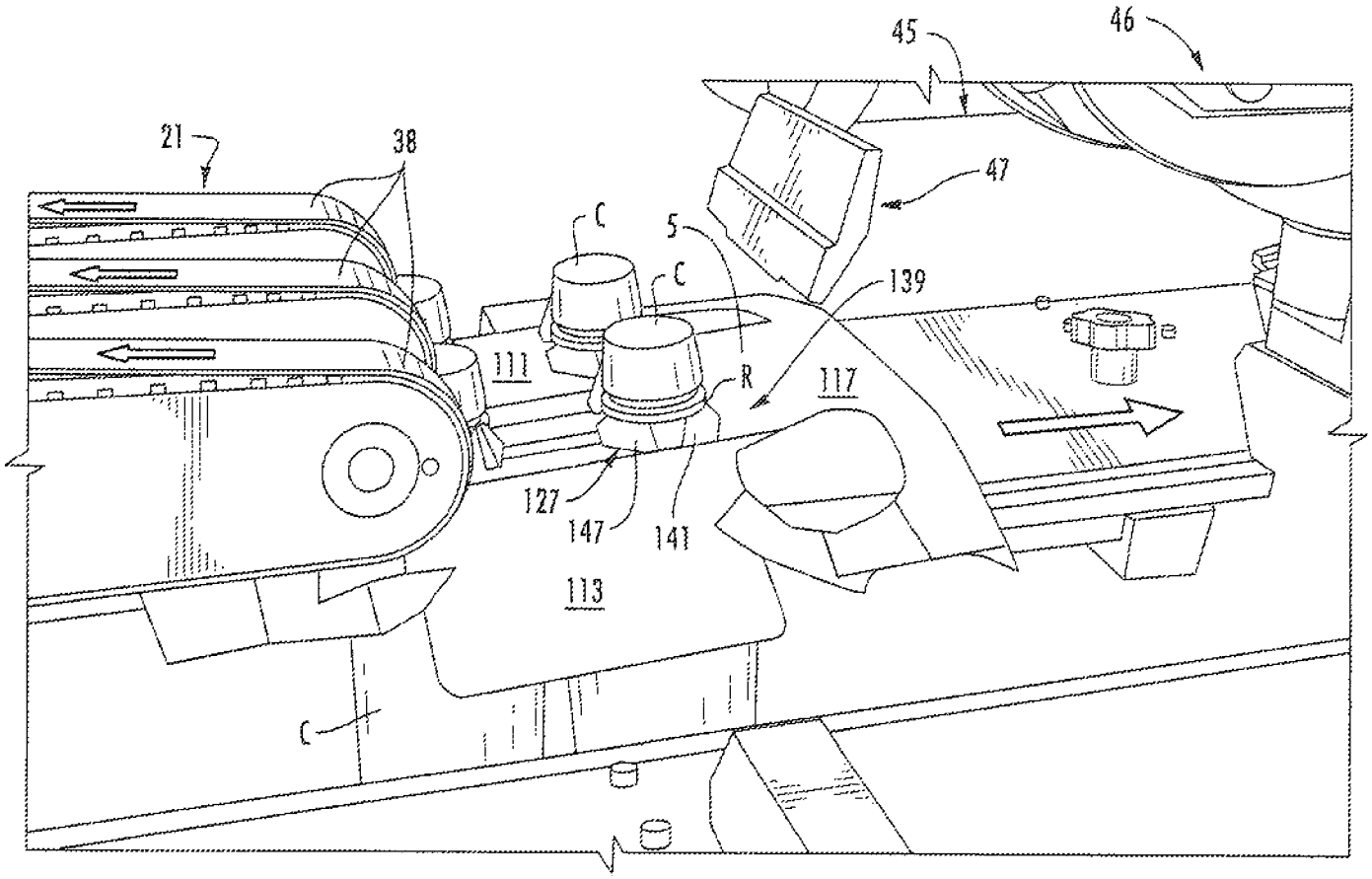
FIG. 6 is a schematic view of a portion of the blank handling apparatus with a carton blank being pressed onto a top of a group of articles and a portion of a folding mechanism.

FIG. 5 illustrates a portion of the carton chute 19 with carton blanks 5 being moved down the carton chute by the spacer pins 31 attached to the endless chains 27. As the carton blanks 5 move down the chute 19, they are discharged from the chute and received by a presser assembly 21 that is adjacent the carton chute. The carton presser assembly 21 comprises an array of spaced endless belts 38 having lower flights that move in synchronization with the adjacent carton blanks below. Further, the endless presser belts 38 are spaced apart such that they straddle a respective row of beverage bottles C of a group of articles being conveyed in synchronization with each carton blank 5 below the presser assembly 21. Thus, the carton blanks 5 are conveyed in synchronization with corresponding underlying groups of beverage bottles C and are held down as they approach the groups of bottles by the endless presser belts 38 of the presser assembly 21. The presser assembly 21 presses each carton blank 5 onto the tops of the containers C and causes the receptacles 127 of each blank to engages the tops of the containers of a group of containers. As illustrated in FIG. 6, the discharge of the presser assembly 21 is below the tops of the containers C to cause the tops of the containers to extend through the receptacles 127 so that the flaps 141, 143, 145, 147 of each receptacle engage a rim R of the container that is inserted through the top panel 111 of the blank 5. The carton blanks 5 are thus held in place on the top of a group of bottles C by the mechanical locking action of the flaps 141, 143, 145, 147 that engage the rim R of the container C. As the carton blanks 5 that are now attached to the group of articles C are moved past the presser assembly 21, the attached carton blanks encounter the folding mechanism 45 that further folds the panels and flaps of the blank.

Figure 7:
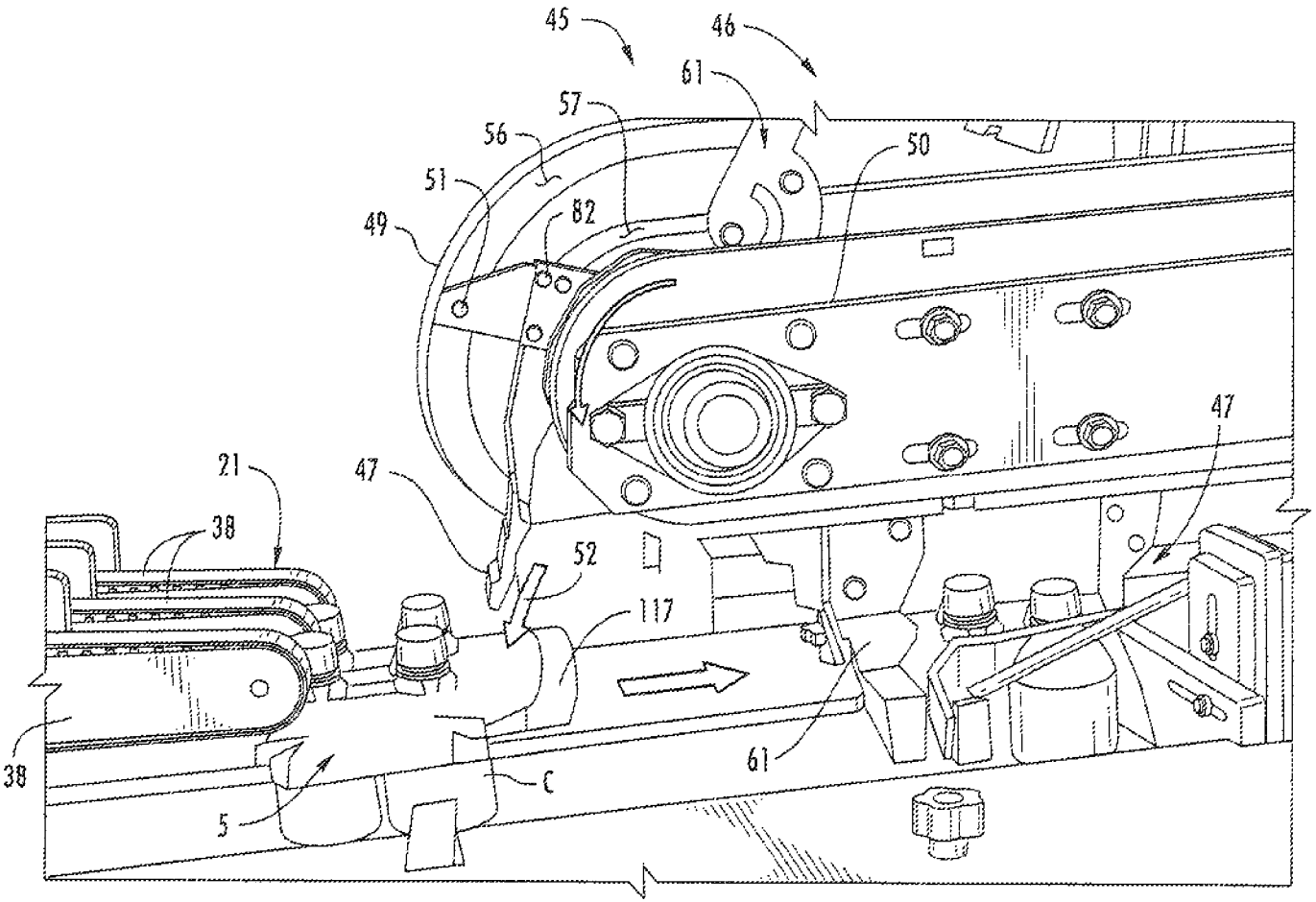
FIG. 7 is a schematic view similar to FIG. 6 but showing detail of the folding mechanism.
Figure 8:
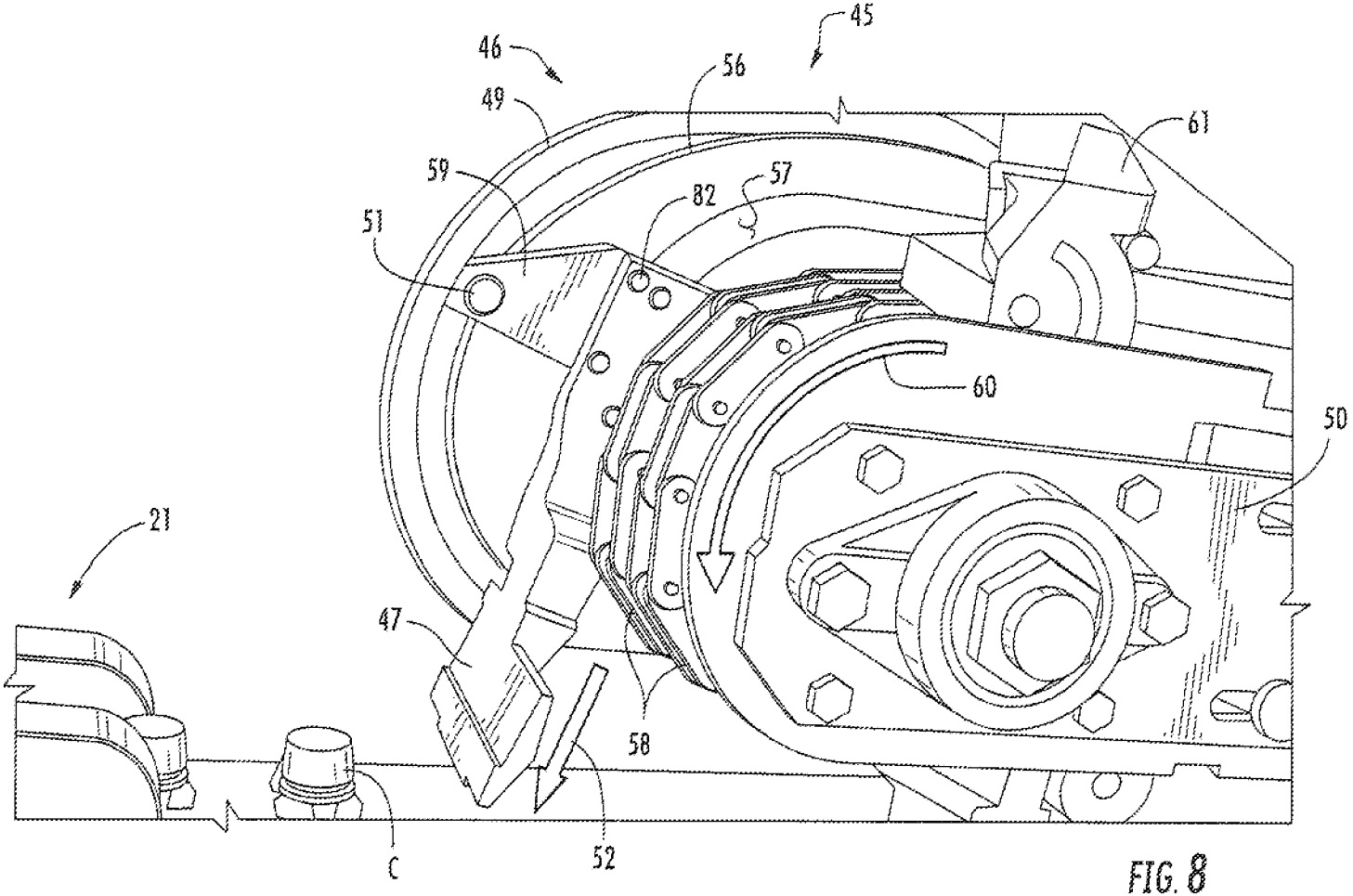
FIG. 8 is a schematic view showing further detail of the folding mechanism.

FIGS. 7 and 8 illustrate the upstream end of the folding mechanism 45 that comprises an overhead lug assembly 46. The lug assembly 46 has a support frame 50 that carries a pair of endless chains 58 (FIG. 8). An array of leading lugs 47 are secured at intervals to one of the endless chains 58 and an array of trailing lugs 61 are secured at intervals to the other one of the endless chains 58. The leading lugs 47 and trailing lugs 61 move sequentially in front of and behind each group of articles C and attached carton blank 5 as the attached blank and article groups move along the processing path P. The leading lugs 47 are for folding a leading end portion (e.g., side panel 117) of the attached blank 5 such that a respective leading lug folds down a respective side panel 117 of the attached blank 5. The trailing lugs 61 are for folding a trailing end portion (e.g., side panel 121) of the attached blank 5 such that a respective trailing lug folds down a respective side panel 121 of the attached blank. As described in more detail below, the leading and trailing lugs 47, 61 are pivotally attached to their respective chains 58 so that they can rotate or pivot with respect to the direction of movement of the chain to fold the respective portions of the blanks 5 in an efficient and effective manner.

To facilitate and control this rotational or pivotal movement of the lugs 47, 61, the lugs are provided with outer cam followers (outer follower 51 being visible in FIGS. 7 and 14) and inner cam followers (inner cam follower 82 being visible in FIGS. 7 and 14) that ride in strategically configured outer and inner cam tracks 56, 57 (FIG. 8) formed in cam plates 49. In this way, the lugs 47, 61 can be pivoted to move almost directly downwardly in front of or behind a group of bottles C rather than rotating in an arc corresponding to the movement of the chains 58 on respective end sprockets in front of or behind the group. The downward movement of the lugs 47, 61 allows closer spacing of the bottle groups C and thus higher throughput of the apparatus 11. The process is illustrated in FIG. 7 where leading lug 47 is seen to have been pivoted downwardly by its cam followers 51, 82 moving in the respective outer and inner cam tracks 56, 57 until it is oriented substantially parallel to the direction of movement of its endless chain 58 around its sprocket. Thus, rather than rotating in a wide arc around the sprocket, the leading lug 47 moves virtually straight down as indicated by arrow 52 until it engages the leading flap 117 of the carton blank 5 attached to a moving group of bottles C. The leading lug 47 thus presses or folds the leading flap 117 downwardly in front of the group of bottles C. As the leading lug 47 rounds its sprocket, cam followers 51, 82 cooperating again with the adjacent cam tracks 56, 57, progressively rotates or pivots the lug to keep it engaged with the front of the bottle group and hold the leading flap 117 in place against the bottles C.

FIG. 8 further illustrates the above-described features of the leading lug 47 rotating around the end of the lug assembly 46 and engaging the leading flap 117. The leading lug 47 is pivotally attached to one of the pair of endless chains 58, which is being driven in the direction indicated by arrow 60. An extender plate 59 projects from the leading lug 47 and carries the outer cam follower 51 and an inner cam follower 82. The outer cam follower 51 rides in the outer cam track 56 and the inner cam follower 82 rides in inner cam track 57. Two cam tracks 56, 57 and two cam followers 51, 82 are used to rotate the leading lug 47 at an extreme angle relative to the direction of its endless chain 58. The first portion of this rotation is controlled by the outer cam follower 51 riding in the outer cam track 56. When the angle of rotation nears the limit of control capable by the configuration of the outer cam follower 51 (e.g., too steep an angle with respect to the direction of the chain 58), then the inner cam follower 82 riding in the inner cam track 57 causes the leading lug 47 to further rotate through the remainder of the required angle in order for the leading lug to be driven downward in the direction of arrow 52 toward the leading flap 117. At locations where the outer cam follower 51 and outer cam track 56 are controlling rotation of the leading lug 47, the inner cam track 57 is widened such that the inner cam follower 82 is not operative. Similarly, at locations where the inner cam follower 82 and inner cam track 57 are controlling rotation of the leading lug 47, the outer cam track 56 is widened so that the outer cam follower 51 is not operative. In this way, only one cam follower 51, 82 and cam track 56, 57 are operating at any one time to avoid binding or interference that can cause intermittent movement of the leading lug 47. In the illustrated configuration, the leading lug 47 is rotated until it is oriented virtually along the direction of movement of the chain 58 as the chain rounds its sprocket. The leading lug 47 thus moves in a downward direction as indicated by arrow 52 rather than swinging through a large arc as it would do if it remained oriented at a right angle relative to its endless chain. It thus slips down at the appropriate orientation in front of an oncoming group of articles C to fold the leading flap 117 of the carton blank 5 down against the leading side of the group of articles. Such downward movement of the leading lug 47 results from the configuration of the cam followers 51, 82 and cam tracks 56, 57 that rotate the leading lug relative to the chain 58.

Figure 9:
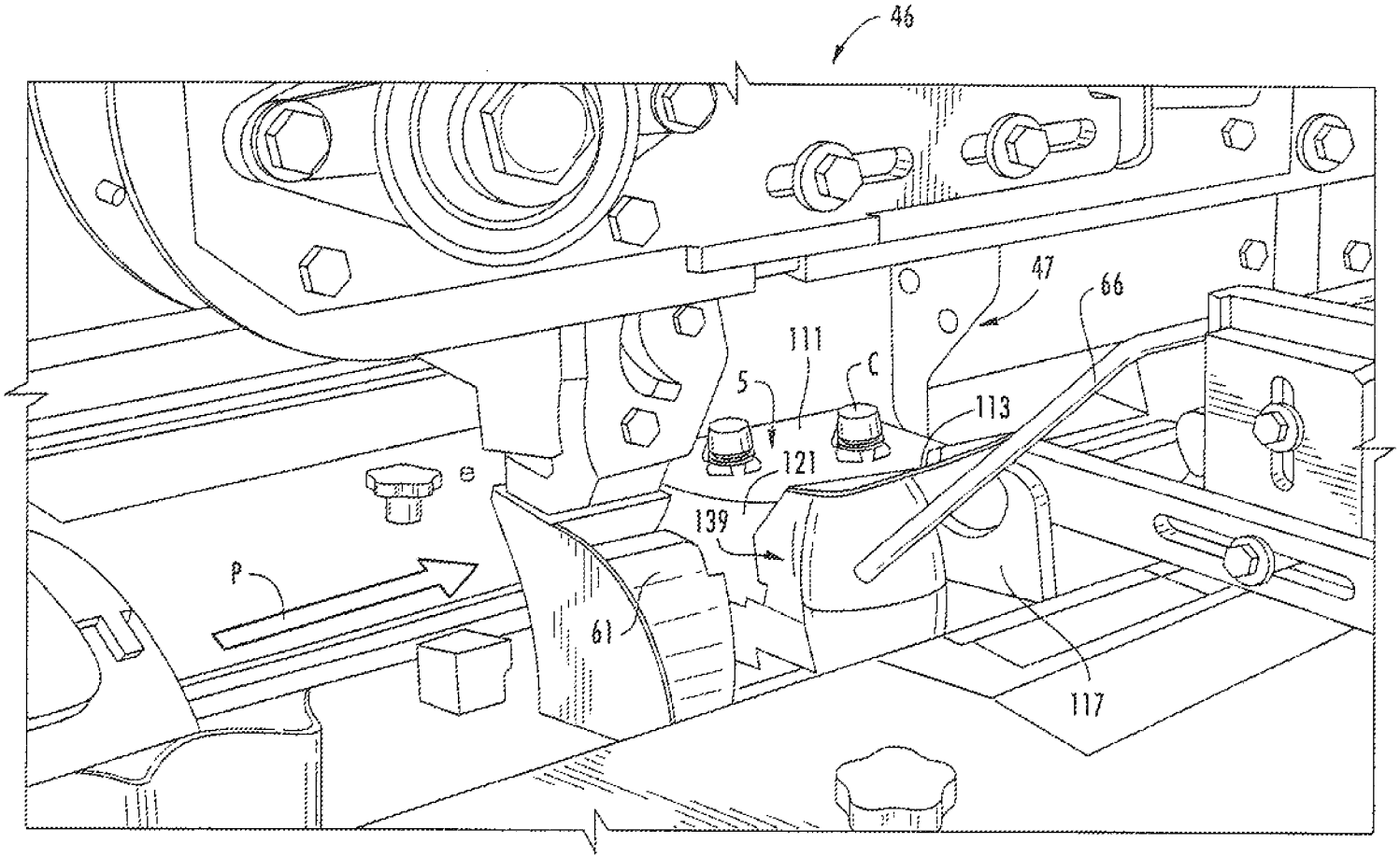
FIG. 9 is a schematic view showing further detail of the folding mechanism as the group of articles advances in the carton forming apparatus.
Figure 10:
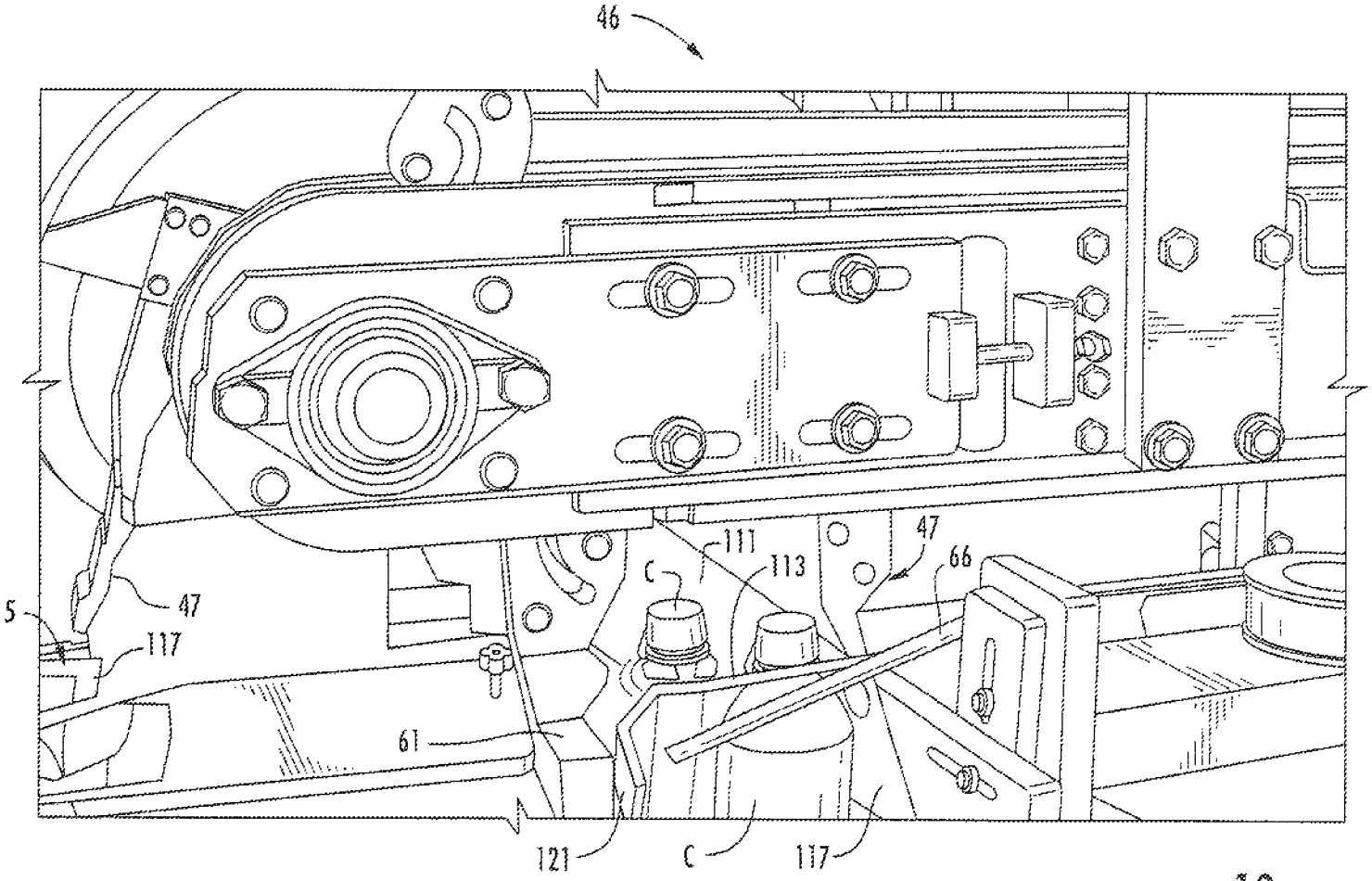
FIG. 10 is a view similar to FIG. 9.
Figure 11:
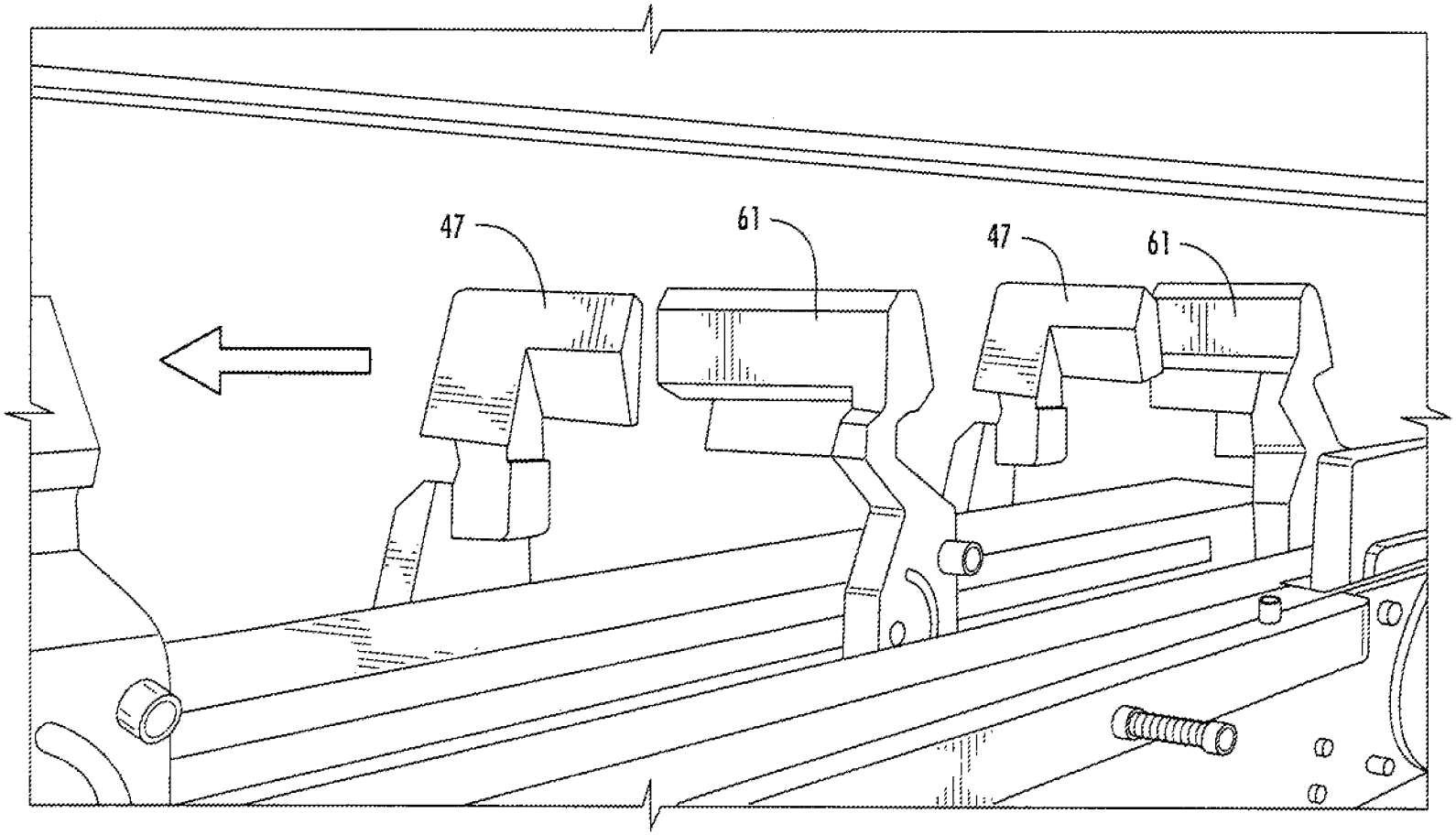
FIG. 11 is a schematic view of a top portion of the folding mechanism that is above the path of travel of the group of articles.

Once the leading lug 47 rotates in front of the group of articles C, the trailing lug 61 rotates downwardly in a similar manner (guided by the cam tracks 56, 57 and inner and outer cam followers) behind the group of articles to fold down the trailing flap (e.g., side panel 121) of the carton blank 5 against the trailing end of the group of articles C. FIGS. 9 and 10 illustrate the trailing lug 61 in position after folding down the trailing flap 121 and positioned behind the group of articles holding the trailing flap against the group. The leading flap 117 is also shown being held against the leading end of the group of articles by the leading lug 47 as described above. The lugs 47, 61 and the group of articles are moving together along the processing path P. Significantly, it has been found that the cam followers of the leading and trailing lugs can be used at this stage of the process to move the leading and trailing lugs into tight engagement with group of articles and the carton flaps using cam tracks or cam surfaces that interact with the cam followers. While slightly visible in FIG. 9, and more apparent in FIG. 18, the trailing lug 61 has a face 96 that is formed with forwardly curved ends 97 that wrap slightly around the group of bottles when the trailing lug engages them. This causes the trailing gussets 139 of the carton to begin to wrap around the sides of the group as shown. A static rail 66 is positioned to engage a respective end flaps 113, 115 of the carton blank 5 to raise and hold it up to allow the leading and trailing gussets 139 to be folded completely inwardly against the sides of the group of bottles C, as detailed below. Only one static rail 66 is shown that engages end flap 113, but it is understood that a second static rail can be provide on the opposite side of the attached carton blank 5 to position the end flap 115 in a similar manner. As shown in FIG. 10, the next successive leading lug 47 is being moved downward as described above to contact the leading flap 117 of the next attached blank 5 and group of bottles to repeat the process. In this way, groups of bottles C are packaged continuously and sequentially as they move along the processing path P.

Figure 12:
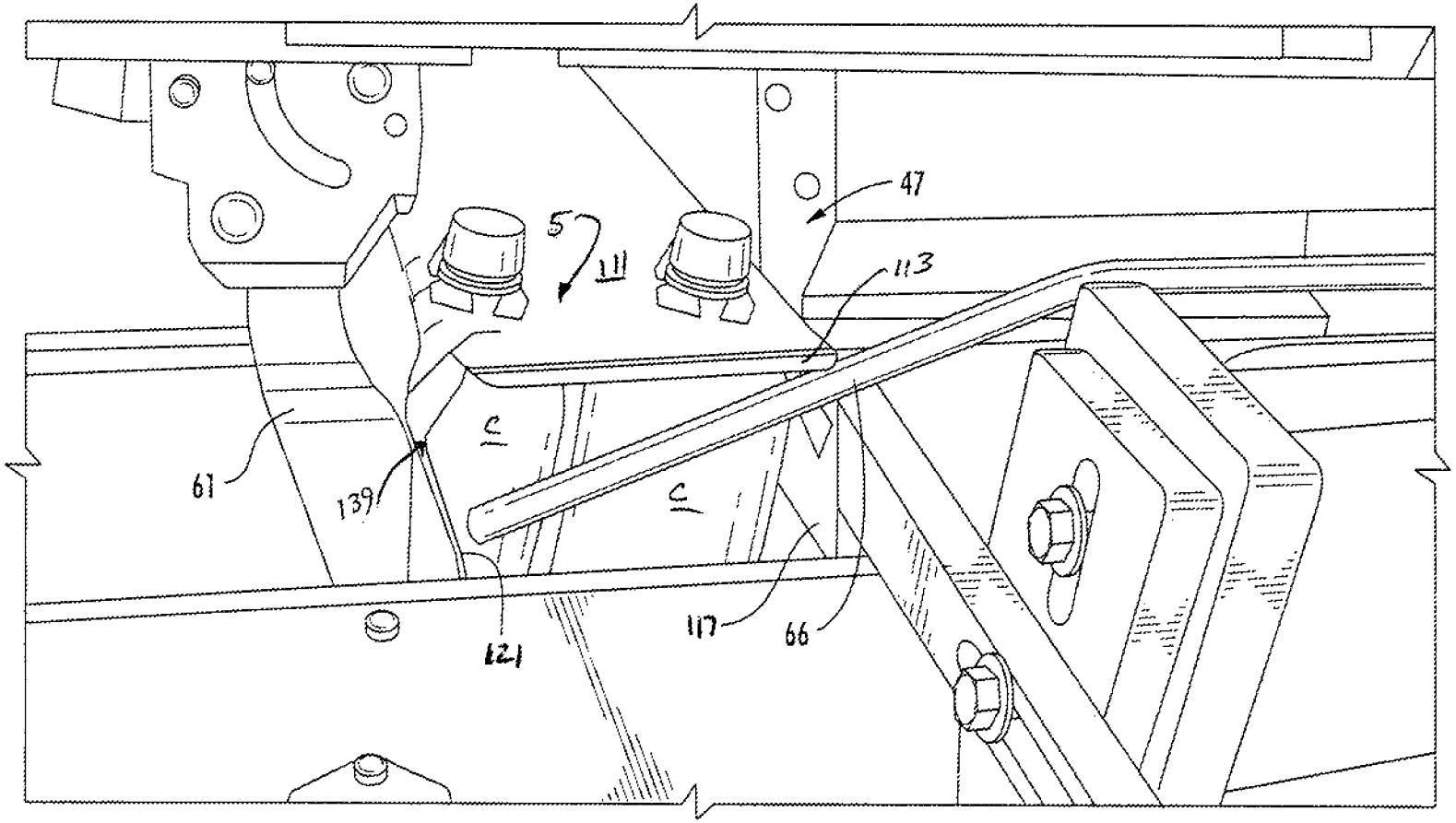
FIG. 12 is a schematic view similar to FIG. 9.
Figure 12A:
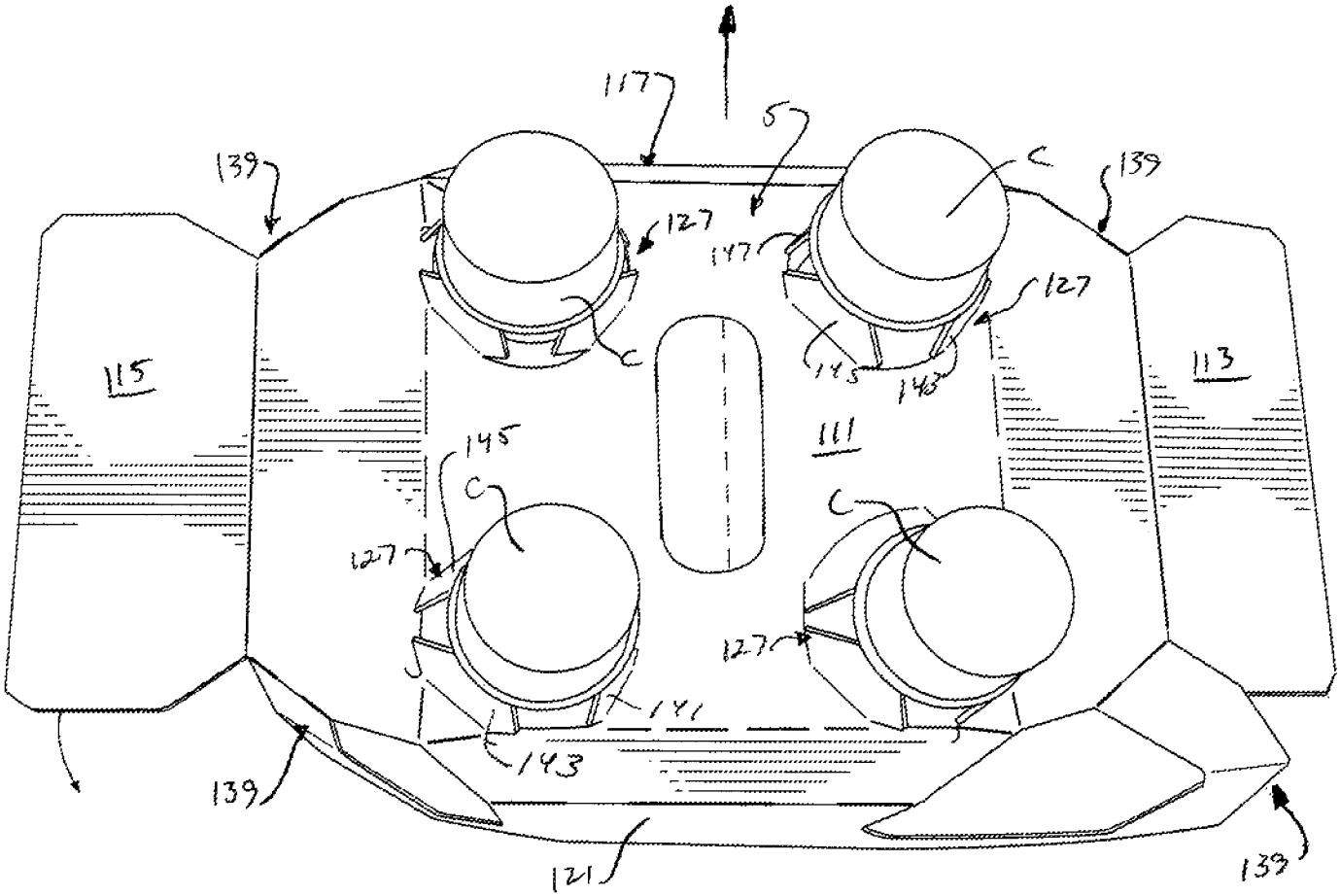
FIG. 12A is a detail of the partially formed carton removed from the apparatus and configured as shown in FIGS. 9, 10, and 12.

The entire overhead lug assembly 46 of the folding mechanism 45 can be raised and lowered, and the endless chains 58 can be moved apart and together and phased relative to each other to accommodate other carton blank configurations and/or other bottle group formations. In this way, the same packaging machine 11 can be converted to apply cartons to groups of bottles of various configurations. For example, 2×4 groups of bottles and 2×6 groups of bottles, as well as groups of bottles of different sizes can be accommodated by appropriate adjustment of the overhead lug assembly and perhaps replacement of the lugs with lugs sized for the particular size and configuration of the groups of bottles being packaged. FIG. 12 is another view showing the leading and trailing flaps 117, 121 of the carton blank 5 being held against the group of articles C with the leading and trailing lugs 47, 61 as described above. FIG. 12A shows the attached carton blank 5 and bottles C removed from the apparatus of FIG. 12 with the leading and trailing side panels 117, 121 downwardly folded and being held in the position of FIG. 12 by the leading and trailing lugs 47, 61. The end panels 113, 115 of the attached carton blank 5 are shown as positioned in the folding mechanism 45 of FIG. 12 just prior to engagement with the static rail 66.

Figure 13:
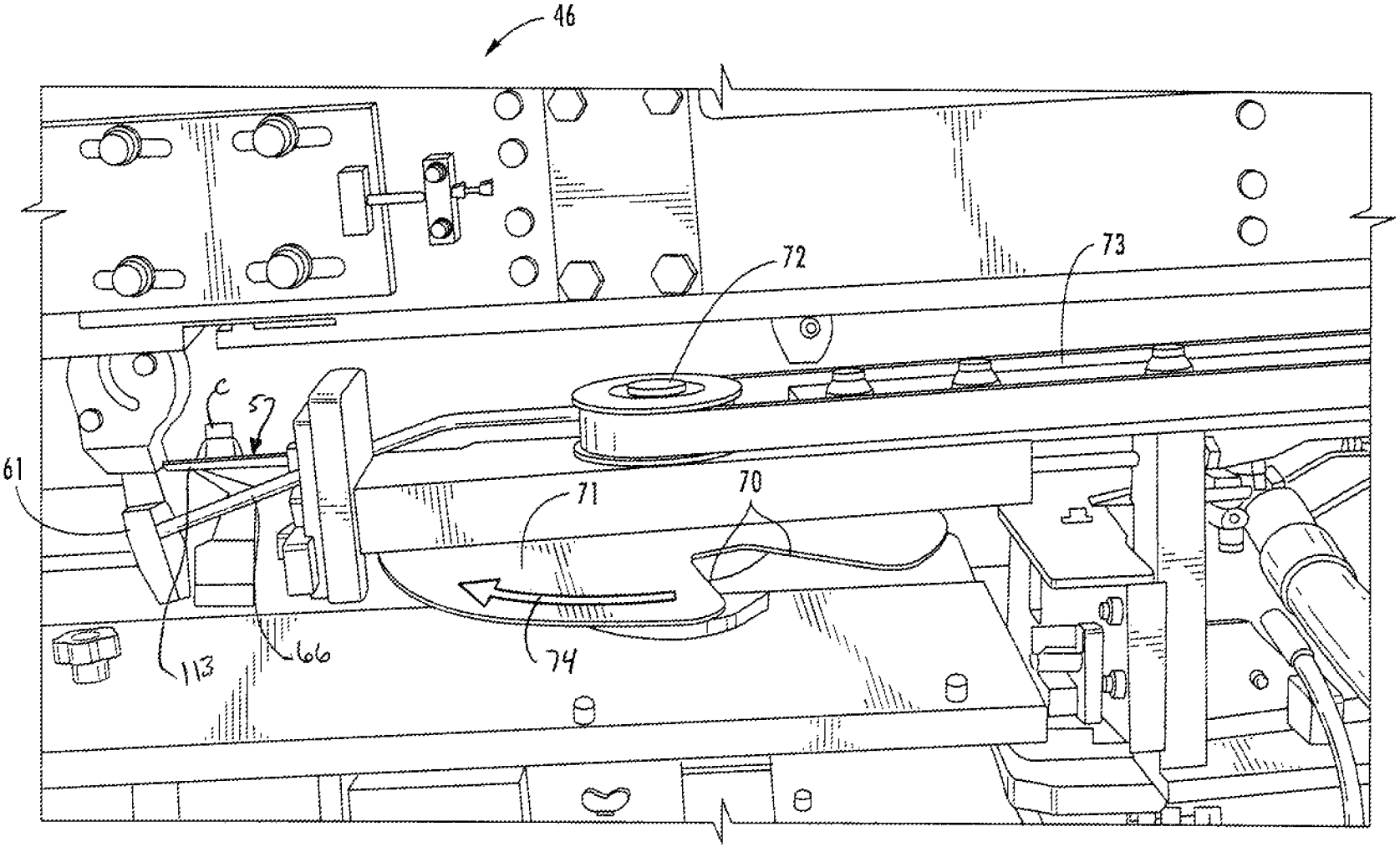
FIG. 13 is a schematic illustrating additional features of the folding mechanism as the group of articles advances in the carton forming apparatus.
Figure 13A:
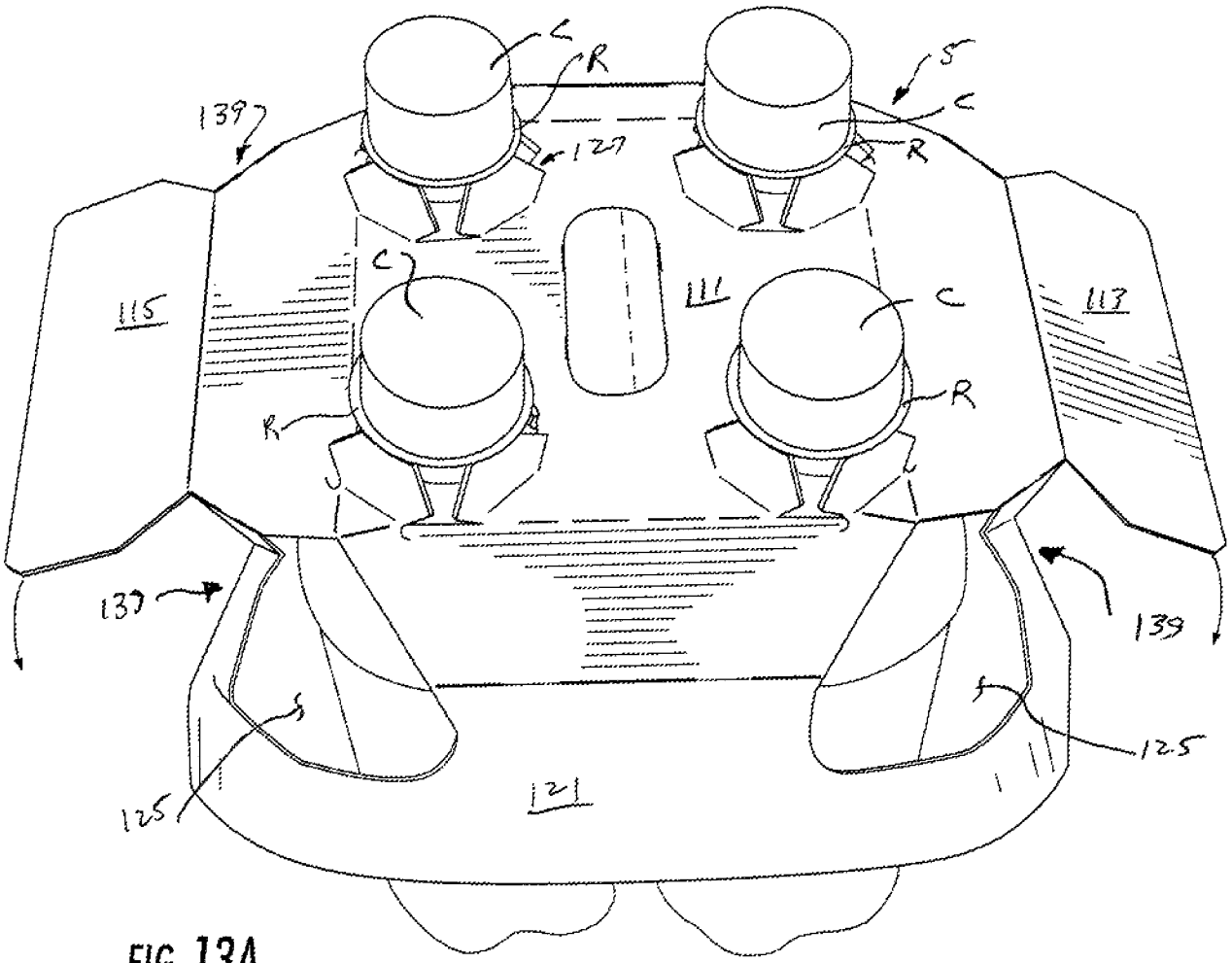
FIG. 13A is a detail of the partially formed carton removed from the folding mechanism illustrated in FIG. 13.
Figure 13B:
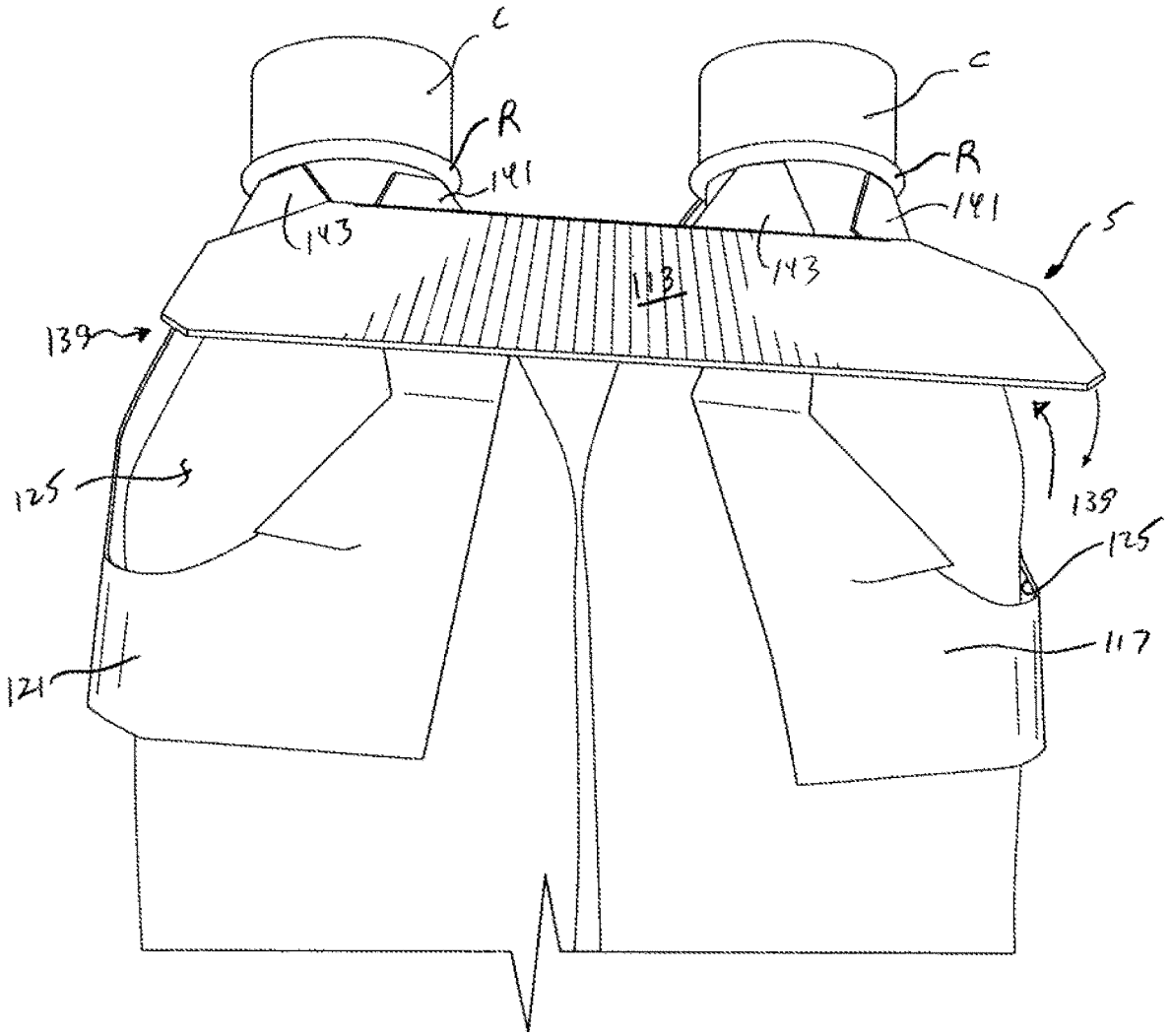
FIGS. 13B thru 13C are details of the partially formed carton that is further formed from the view of FIG. 13A.
Figure 13C:
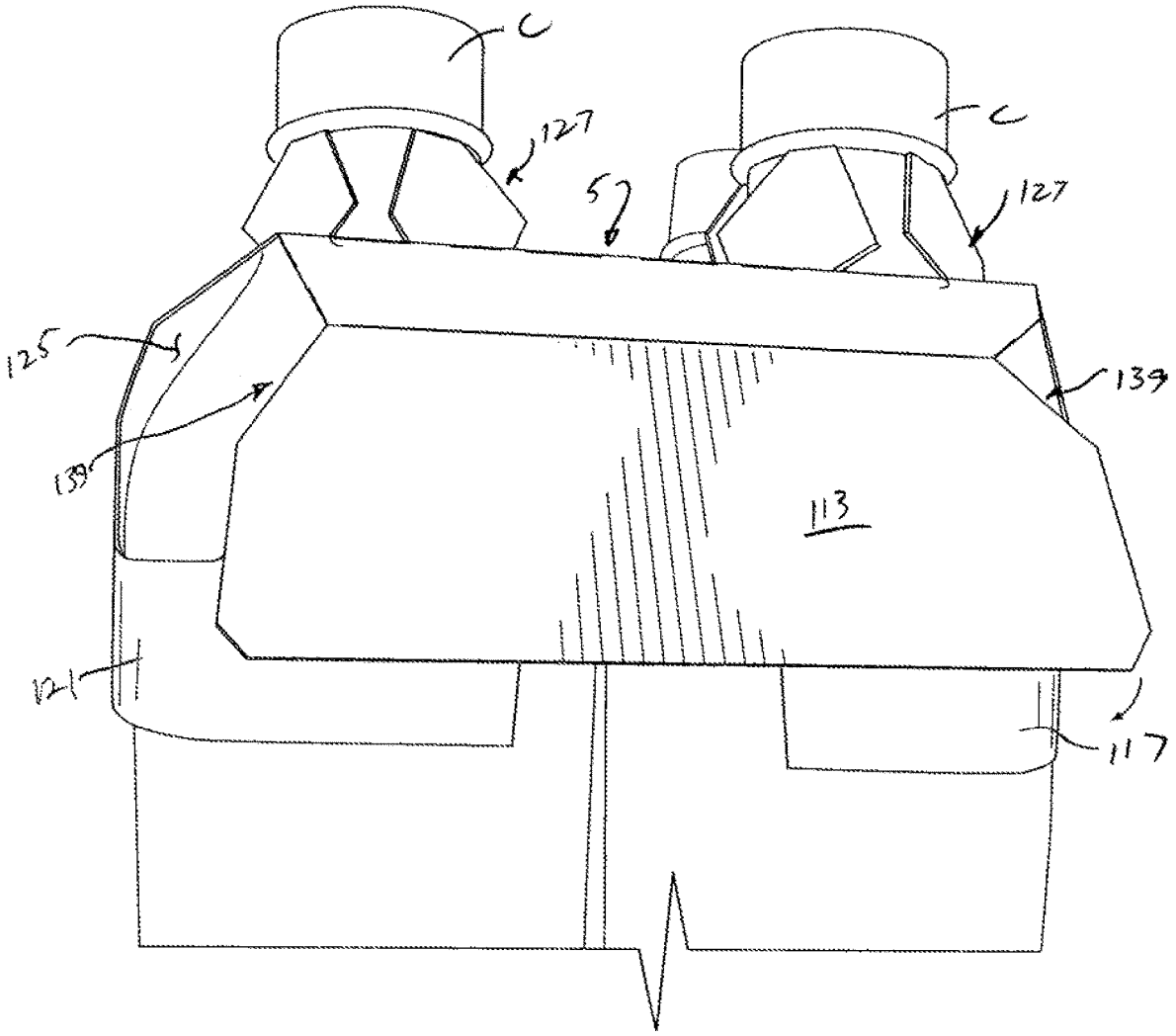
Figure 13D:
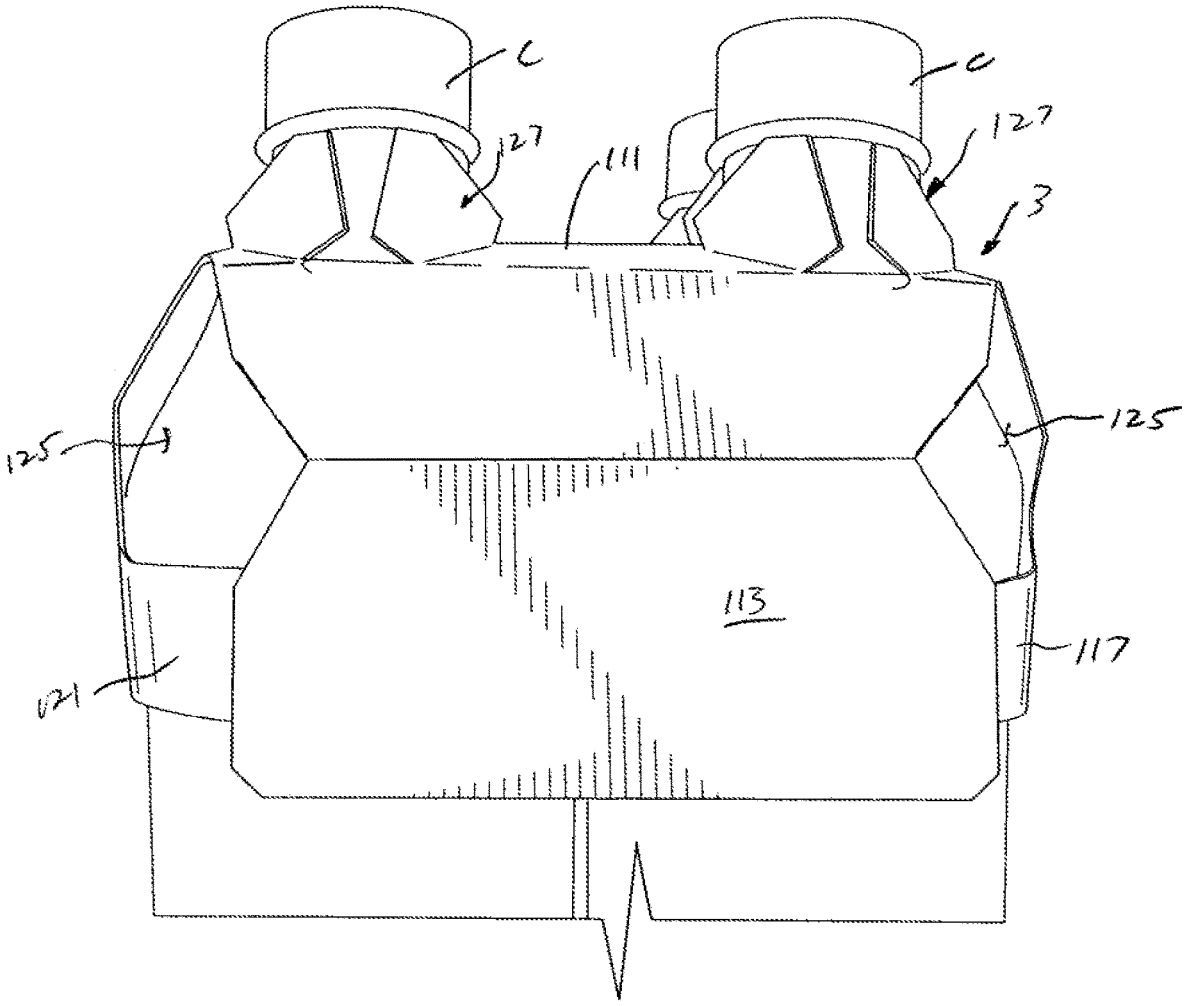
FIGS. 13D and 13E are details of the formed carton that is further formed from the view of FIG. 13C.
Figure 13E:
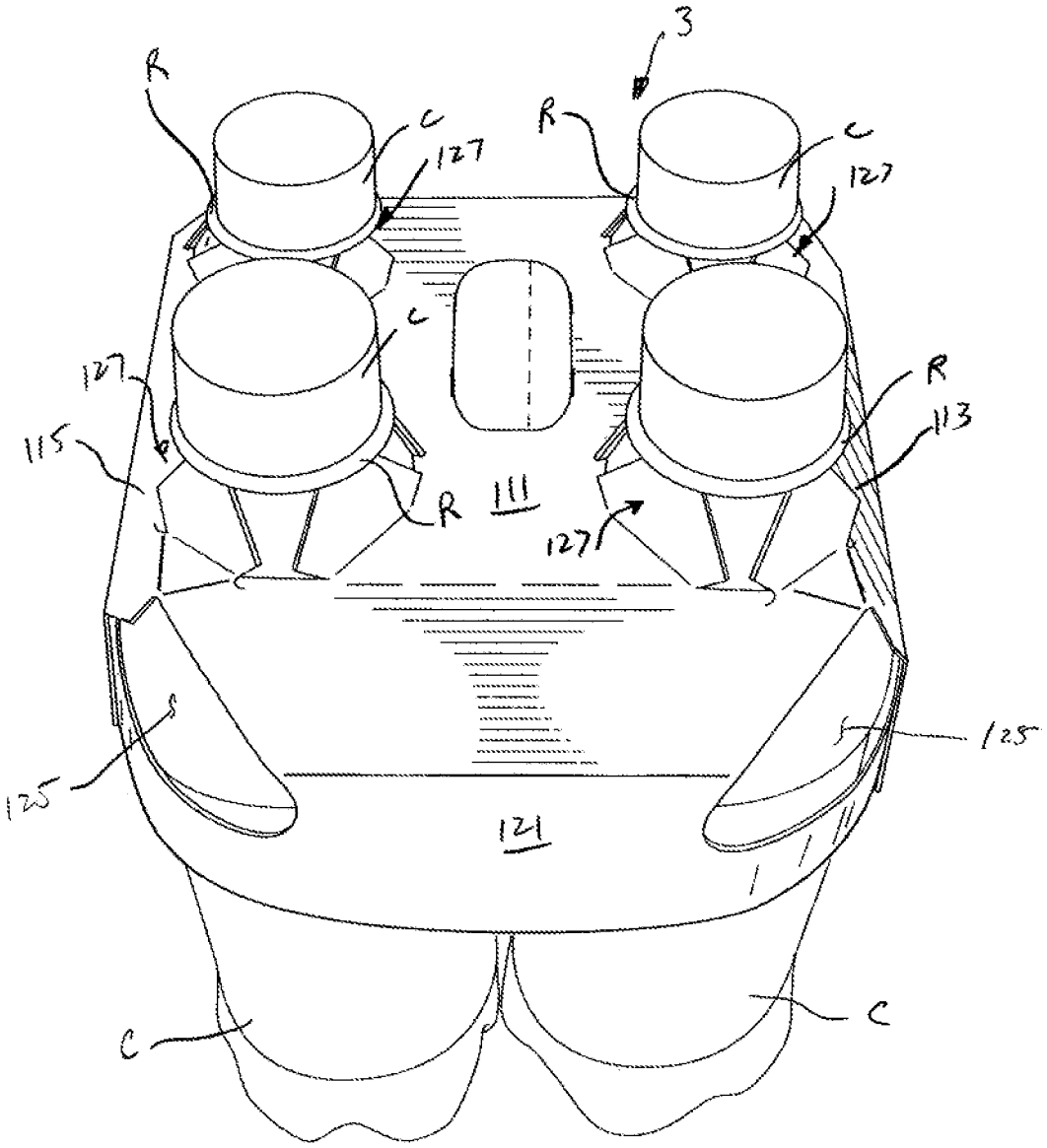

After having been captured between the lugs 47, 61 as described, the attached carton blank 5 and group of bottles C move downstream to a tucking wheel 71, shown in FIG. 13, which folds or tucks the leading and trailing gussets 139 of the attached carton blank 5 inwardly against the sides of the group of bottles C. More specifically, the tucking wheel 71 is a generally circular relative thin plate that is rotated by a belt 73 and sheave 72 in the direction indicated by the arrow 74 in FIG. 13. The tucking wheel 71 is rotated at a rate such that its outer peripheral surface moves faster than the speed of the groups of articles B with attached carton blanks 5 traveling along the adjacent processing path P. The tucking wheel 71 is formed with a gap 70 at a predetermined location around its circumference, and the rotation of the tucking wheel is timed such that the gap 70 engages the trailing gusset 139 of a carton blank 5 attached to the group of articles C as the attached blank and articles are moved adjacent the tucking wheel to fold the gusset inwardly against the side of the bottle group. As a group of bottles with attached blank 5 reaches the tucking wheel 71, the leading gusset 139 encounters the edge of the wheel, which although rotating, acts as a static plow or stop that folds the leading gusset back against the side of the group when the advancing attached blank 5 comes into contact with the tucking wheel. As the trailing gusset 139 reaches the tucking wheel 71, the gap 70 aligns with it so that the gusset falls into the gap. Further rotation of the tucking wheel 71 in the indicated direction 74 urges the trailing gusset 139 inwardly in the downstream direction against the side of the group of bottles. This results in improved positioning and placement of the gussets 139 with respect to the end flaps 113, 115 and side flaps 117, 121 so that when the end flaps are folded down and glued to the folded gussets, the flap is precisely aligned with the gussets. This contrasts with simply folding the gussets 139 with a static rail or plow, which can skew their positions through friction and result in a less pleasing alignment of the end flaps 113, 115, side flaps 117, 121, side flap and the gussets in the formed carton 3. A similar tucking wheel (not shown) as the tucking wheel 71 is provide on the opposite side of the processing path P to fold the gussets 139 on the opposite side of the attached blank 5 in the same manner. FIGS. 13A thru 13E illustrate the attached blank 5 removed from the folding apparatus 45 and being formed into the carton 3 by having the gussets 139 inwardly folded by the tucking wheel 71 and the end panels 113, 115 downwardly folded.

After the gussets 139 are folded inwardly, adhesive is applied, and the end panels 113, 115 are urged downwardly and inwardly by a static rail or plow (not shown) into engagement with the folded gussets 139 to complete the wrapping of the carton 5 around the upper portion of the group of articles C. The wrapped group of articles C then moves beyond the overhead lug assembly 46 and between the moving compression belts 24 (FIG. 1), which hold the side flaps against the gussets until the adhesive is cured. The packaged group of bottles C then moves beyond the packaging machine 11 to downstream locations for further handling.

Figure 14:
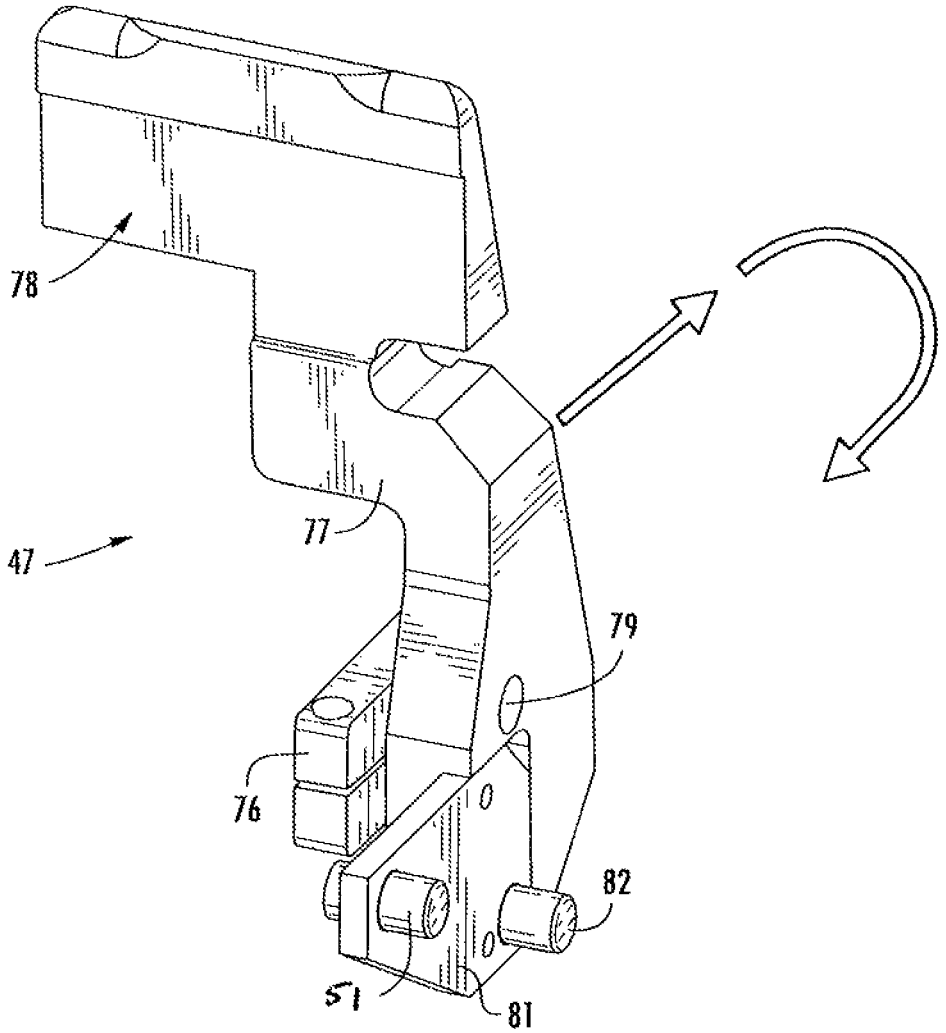
FIG. 14 is an enlarged detail view of a leading lug of the folding mechanism overhead to one illustrated embodiment.

FIG. 14 shows one possible embodiment of a leading lug 47 according to the disclosure and as seen from the back side to illustrate the cam follower arrangement thereon. The leading lug 47 includes a chain mount 76 that is securable to the endless chain 58 associated with the leading lug. The arm 77 of the lug is pivotally mounted to the chain mount with a pivot pin 79 so that it can rotate with respect to the chain mount and the chain. The arm 77 terminates in a paddle-like head 78 having a face that is substantially planar. An extender plate 81 projects from the base of the lug 47 and carries the inner cam follower 82 and the outer cam follower 51 that ride in respective inner and outer cam tracks 57, 56 to rotate the lug as described above. The lug 47 can be made of any suitable material such as plastic, nylon, aluminum or the like and it will be understood that lugs of different sizes and configurations can be substituted according the shape, configuration, and size of articles being packaged.

Figure 15:
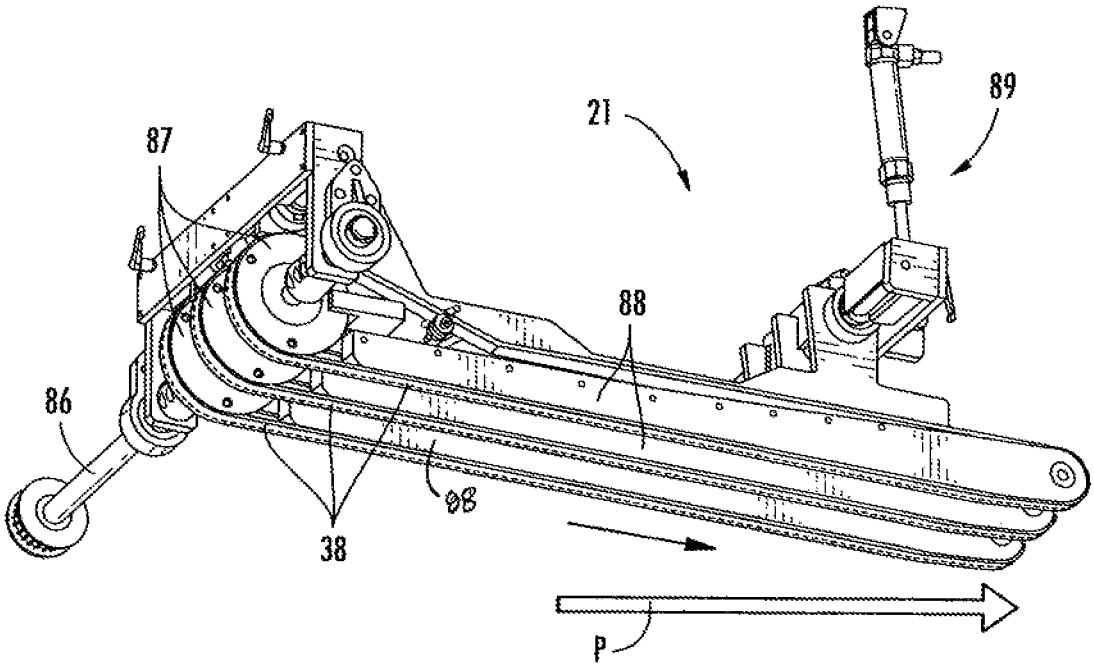
FIG. 15 is an enlarged detail view of a presser assembly of the blank handling apparatus according to one illustrated embodiment.

FIG. 15 illustrates one embodiment of the presser assembly 21 that presses carton blanks 5 onto the tops of bottle groups C as described. The presser assembly 21 includes a drive shaft 86 that drives a set of sheaves 87 for moving endless belts 38 in a downstream direction and downwardly toward the processing path P. The endless belts 38 ride on belt guides 88 to keep them in proper position for pressing carton blanks 5 onto groups of bottles C. The belts 38 are spaced to move between the tops of bottles C in the respective rows of each bottle group or outboard of the side bottles of the group so that they can move below the tops to press the carton blanks onto the tops as described above. The presser assembly 21 could be otherwise shaped, arranged, and/or configured without departing from the disclosure.

Figure 16:
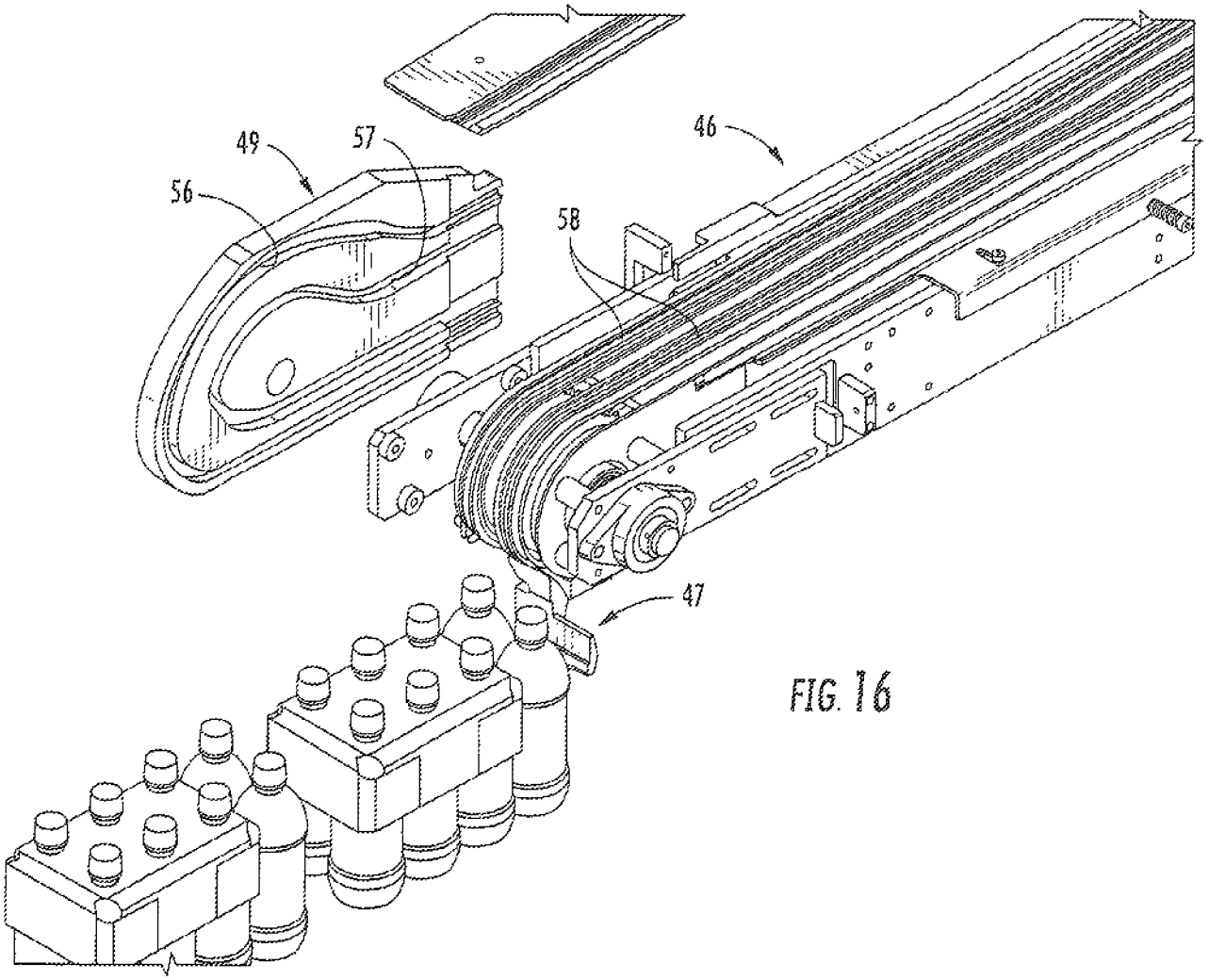
FIG. 16 is a partially exploded perspective illustrating one end of a portion of the folding mechanism.

FIG. 16 shows the upstream end of the overhead lug assembly 46 and illustrates the cam plate 49 with inner cam track 57 and outer cam track 56. As discussed above, the outer cam track 56 acts on the outer cam follower 51 for part of the rotation of a leading lug 47 until the inner cam track 57 and inner cam follower 82 take over. It can be seen in FIG. 16 that the outer cam track 56 is widened at locations where the inner cam track 57 is controlling rotation so that only one cam follower 51, 82 is operational at any one time during rotation of the leading lug 47 relative to its chain 58.

Figure 17:
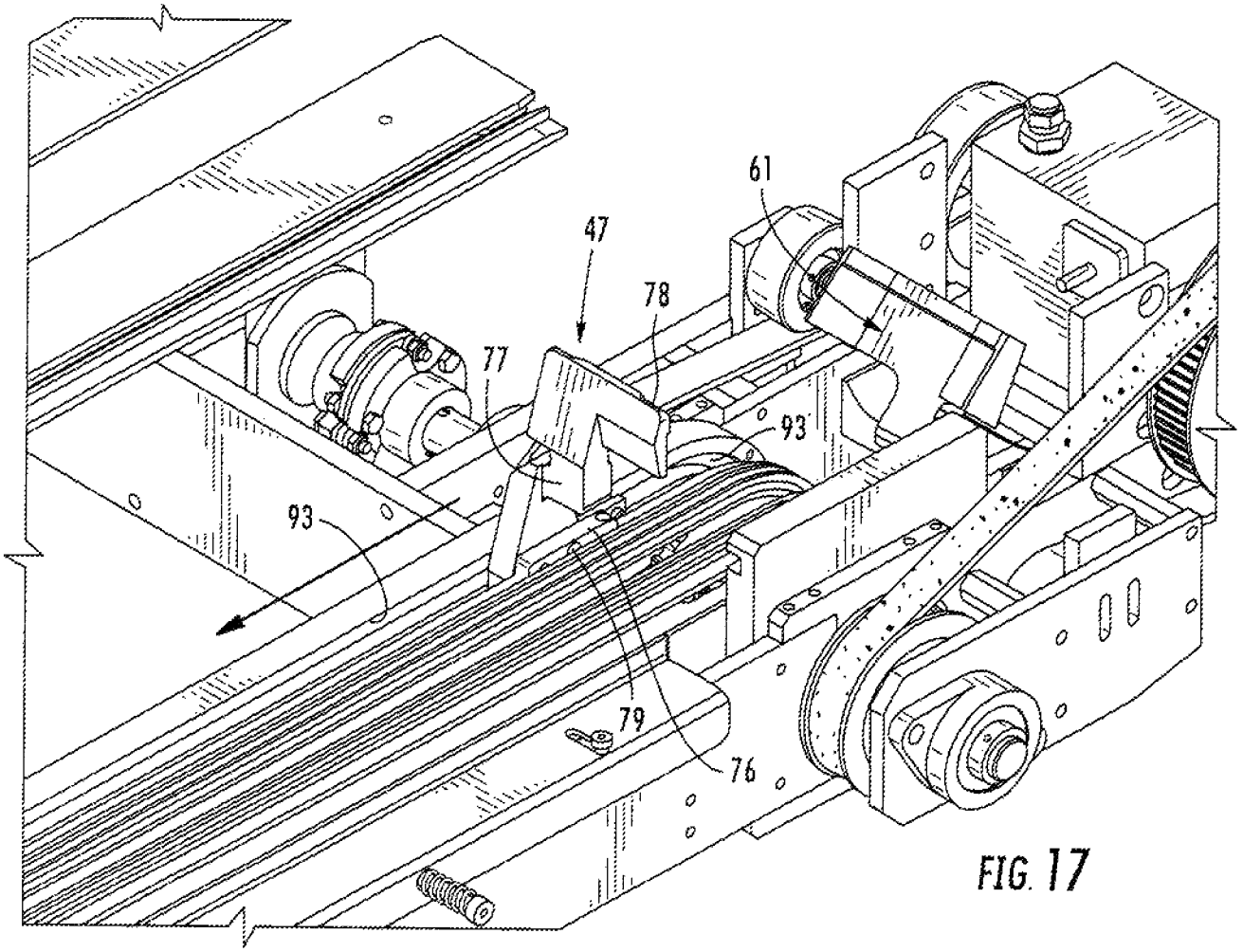
FIG. 17 is a detailed perspective view of a second end of the portion of the folding mechanism of FIG. 16.

FIG. 17 illustrates a downstream end of the overhead lug assembly 46 showing a pair of lugs 47, 61 rotating back up on the return flight of the assembly to be carried back to the upstream end for another cycle. The leading lug 47 is held in an upright orientation by cam track 93. The trailing lug 61 is seen to have a face with forwardly curved end portions for initiating folding of the trailing gussets 139 as described above.

Figure 18:
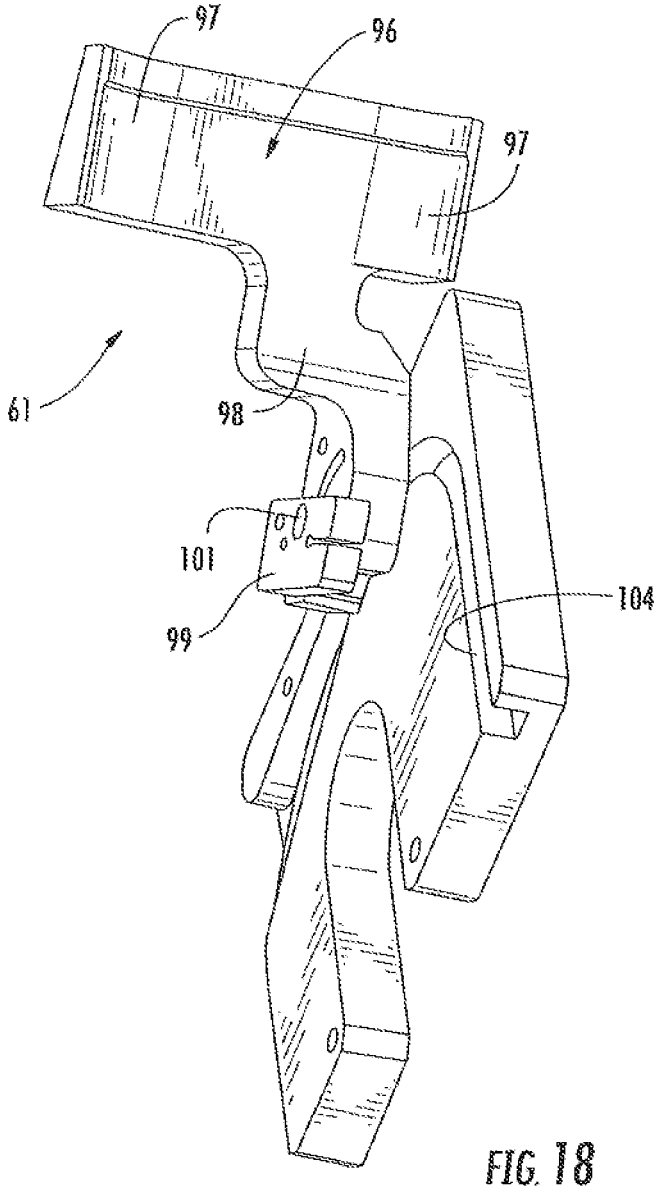
FIG. 18 is a detailed perspective view of a portion of the folding mechanism of FIG. 16 including a trailing lug of one embodiment of the disclosure.
Figure 19:
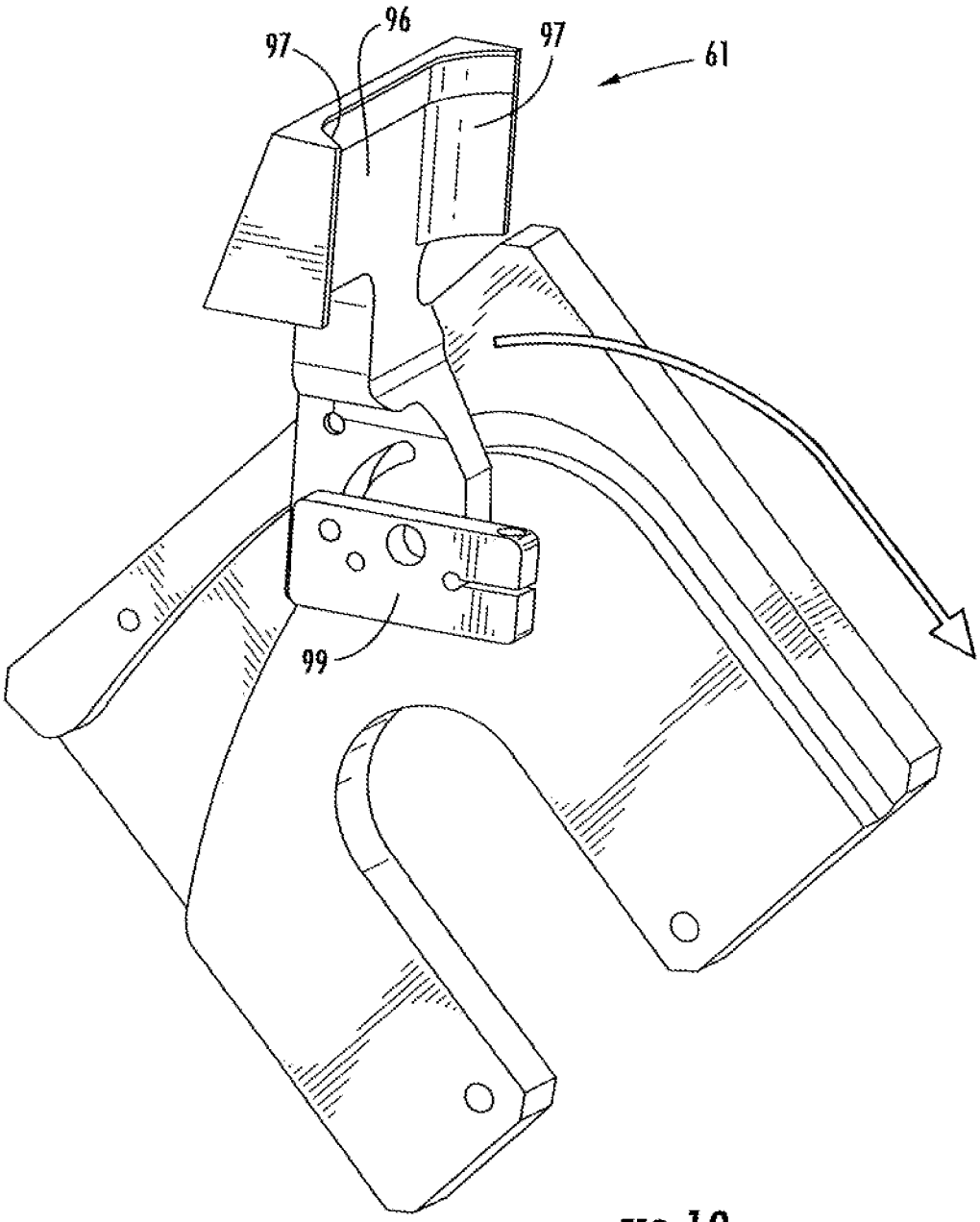
FIG. 19 is a detailed perspective view similar to FIG. 18.

FIG. 18 is a detailed view of one embodiment of a trailing lug 61 according to one embodiment of the disclosure. The trailing lug 61 has an arm 98 to which a chain mount 99 is attached for mounting the lug to its endless chain 58. The lug 61 is pivotally connected to the chain mount 99 with a pivot pin 101 so that it can rotate or pivot relative to the direction of movement of the endless chain 58. A cam follower (not visible in FIG. 18) on the arm 98 projects into a cam track 104 to control the orientation of the lug with respect to the chain to which it is attached. The trailing lug 61 is formed with a head having a face 96 with end portions 97 that are forwardly curved for starting the folding of trailing gussets as previously described. The trailing lug 61 can be made of any appropriate material such as plastic, nylon, metal, or the like and lugs with different configurations can be substituted depending upon the configuration and size of the bottle groups being packaged. FIG. 19 is a view of the trailing lug 61 from a different perspective illustrating the forwardly curved end portions 97 of the lug face. Alternatively, the trailing lug 61 can have an inner cam follower 82 and outer cam follower 51 similar or identical to the cam followers as described above for the leading lug 47.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming a carton containing a group of articles, the method comprising:

positioning a plurality of articles into a plurality of groups of articles and moving the groups of articles along a processing path;

moving a plurality of carton blanks towards the plurality of groups of articles and pressing a respective carton blank of the plurality of carton blanks onto the tops of articles in a respective group of articles of the plurality of groups of articles and engaging the respective carton blank with the tops of the articles;

folding a respective carton blank around the respective group of articles via a folding mechanism comprising at least one leading lug and at least one trailing lug operatively connected to a cam track, the folding comprising folding a leading end portion of the carton blank downwardly against the respective group of articles and folding a trailing end portion of the carton blank downwardly against the respective group of articles, the folding the leading end portion of the carton blank comprising downwardly moving the leading lug to contact the leading end portion and pressing the leading end portion against the croup of articles, and the folding the trailing end portion of the carton blank comprising downwardly moving the trailing lug to contact the trailing end portion of the carton blank and pressing the trailing end portion against the group of articles, wherein the moving the leading lug and the trailing lug comprises moving the leading lug and trailing lug along the cam track to pivot the leading lug and trailing lug in a downward direction, wherein the folding the leading end portion and the folding the trailing end portion comprises moving the leading lug and trailing lug sequentially with a respective group of articles, and wherein the folding mechanism comprises a lug drive mechanism having at least one chain operatively connected to at least one sprocket, the at least one leading lug is pivotally connected to the at least one chain, the folding the leading end portion of the blank comprises moving the leading lug in the downward direction that is tangential to the direction of circular movement of the chain rotating around the sprocket and the leading lug contacts the leading end portion of the blank during movement in the downward direction as the leading lug rotates around the sprocket.

2. The method of claim 1 further comprising folding a respective lateral end portion of the carton blank that is adjacent to and extending between the respective leading end portion and trailing end portion of the carton blank by folding the lateral end portion against the respective group of articles to form a carton at least partially surrounding the group of articles.

3. The method of claim 2 further comprising adhering the leading end portion to the lateral end portion and adhering the trailing end portion to the lateral end portion.

4. The method of claim 1 wherein the pressing the carton blank comprises activating attachment features of the carton blank that attached the carton blank to the group of articles.

5. The method of claim 1 wherein the moving the plurality of carton blanks comprises moving the carton blanks from a first position to a second position, the second position being lower than the first position.

6. The method of claim 5 wherein the moving the plurality of carton blanks comprises moving the plurality of carton blanks along a path of travel that is sloped from a first position to a second position, wherein at the second position the respective carton blank is attached to a respective group of articles.

7. The method of claim 6 wherein the moving the plurality of carton blanks comprises engaging a laterally extending end portion of a respective carton blank with a spacing pin.

8. The method of claim 1 wherein positioning the plurality of articles into a plurality of groups of articles comprises accelerating the movement of the articles such that the groups of articles are moved along the processing path in synchronization with a respective carton blank.

9. The method of claim 1, wherein the downward direction is perpendicular to the processing path.

10. The method of claim 9, wherein the leading lug comprises an arm with a head for contact with the blank, the head is a terminal portion of the arm and the head is non-rotatable with respect to the arm such that the head rotates upon rotation of the arm.

11. The method of claim 10, wherein the folding the leading end portion of the blank comprises moving the arm and the head of the leading lug in the downward so that the head contacts the leading end portion of the blank.

12. The method of claim 11, wherein the cam track comprises a first cam track and a second cam track, the leading lug comprises a first cam follower operatively connected to the first cam track and a second cam follower operatively connected to the second cam track, the first cam track and the second cam track are configured so that as the leading lug is moved around the sprocket by the chain, movement of the first cam follower in the first cam track and movement of the second cam follower in the second cam track causes the moving the arm and the head of the leading lug.

* * * * *